US006788908B2

(12) United States Patent
Sekine

(10) Patent No.: US 6,788,908 B2
(45) Date of Patent: Sep. 7, 2004

(54) PROCESS CARTRIDGE REMANUFACTURING METHOD, DISASSEMBLING METHOD AND ASSEMBLING METHOD, POSITIONING AND CONNECTING APPARATUS AND PROCESS CARTRIDGE

(75) Inventor: Kazumi Sekine, Shizuoka-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/128,329

(22) Filed: Apr. 24, 2002

(65) Prior Publication Data

US 2002/0172528 A1 Nov. 21, 2002

(30) Foreign Application Priority Data

Apr. 27, 2001 (JP) ..... 2001/132619

(51) Int. Cl.[7] ..... G03G 15/00
(52) U.S. Cl. ..... 399/109
(58) Field of Search ..... 399/107, 109, 399/111, 113, 114

(56) References Cited

U.S. PATENT DOCUMENTS

| | | | | |
|---|---|---|---|---|
| 5,331,372 A | | 7/1994 | Tsuda et al. | |
| 5,404,198 A | | 4/1995 | Noda et al. | |
| 5,470,635 A | | 11/1995 | Shirai et al. | 429/131 |
| 5,475,470 A | | 12/1995 | Sasago et al. | |
| 5,488,459 A | | 1/1996 | Tsuda et al. | |
| 5,510,878 A | | 4/1996 | Noda et al. | |
| 5,537,187 A | | 7/1996 | Sekine | |
| 5,583,613 A | | 12/1996 | Kobayashi et al. | |
| 5,602,623 A | | 2/1997 | Nishibata et al. | 399/111 |
| 5,608,509 A | | 3/1997 | Shirai et al. | 399/351 |
| 5,623,328 A | | 4/1997 | Tsuda et al. | 399/111 |
| 5,659,847 A | | 8/1997 | Tsuda et al. | 399/113 |
| 5,669,042 A | | 9/1997 | Kobayashi et al. | 399/111 |
| 5,729,795 A | * | 3/1998 | Kavolius et al. | 399/109 |
| 5,768,660 A | | 6/1998 | Kurihara et al. | 399/111 |
| 5,809,374 A | | 9/1998 | Tsuda et al. | 399/111 |
| 5,828,928 A | | 10/1998 | Sasago et al. | 399/111 |
| 5,937,238 A | * | 8/1999 | Tremblay et al. | 399/109 |
| 5,987,278 A | * | 11/1999 | Nomura et al. | 399/109 |
| 6,009,289 A | | 12/1999 | Sekine et al. | 399/113 |
| 6,029,031 A | | 2/2000 | Yokomori et al. | 399/109 |
| 6,141,513 A | * | 10/2000 | Nishiuwatoko et al. | 399/109 |
| 6,223,010 B1 | * | 4/2001 | Araki | 399/109 |
| 6,542,706 B2 | | 4/2003 | Toba et al. | 399/111 |

FOREIGN PATENT DOCUMENTS

| | | |
|---|---|---|
| JP | 9-62167 | 3/1997 |
| JP | 2000-263550 | 9/2000 |
| JP | 2001-34143 | 2/2001 |

* cited by examiner

*Primary Examiner*—Sandra Brase
(74) *Attorney, Agent, or Firm*—Fitzpatrick, Cella, Harper & Scinto

(57) ABSTRACT

A disassembling method is disclosed for a process cartridge detachably mountable to a main assembly of an electrophotographic image forming apparatus. The process cartridge includes covering members connected to a drum supporting frame and a developer container at ends of the drum supporting frame and the developer accommodating container with respect to a longitudinal direction of the electrophotographic photosensitive drum. The disassembling method includes a step of cutting the cover member adjacent to a connecting portion between the cover member and the drum supporting frame and a connecting portion between the cover member and the developer accommodating container along an outer wall of the covering member.

23 Claims, 21 Drawing Sheets

PROCESS CARTRIDGE REMANUFACTURING METHOD, DISASSEMBLING METHOD AND ASSEMBLING METHOD, POSITIONING AND CONNECTING APPARATUS AND PROCESS CARTRIDGE

FIELD OF THE INVENTION AND RELATED ART

The present invention relates to a process cartridge remanufacturing method, a process cartridge disassembling method involved in a process cartridge remanufacturing method, a process cartridge assembling method, a positioning/fastening apparatus, and a process cartridge.

The term "process cartraidge" means: a cartridge in which a charging means, a developing means or cleaning means, and an electrophotographic photoconductive drum, are integrally disposed, and which is removably mountable in the main assembly of an image forming apparatus; a cartridge in which a minimum of one processing means among a charging means, a developing means, and a cleaning means, and an image bearing means, are integrally disposed, and which is removably mountable in the main assembly of an image forming apparatus; or a cartridge in which a minimum of a charging means and an electrophotographic photoconductive drum, are integrally disposed, and which is removably mountable in the main assembly of an image forming apparatus.

An image forming apparatus includes an electrophotographic copying machine, an electrophotographic printer (for example, LED printer, laser beam printer, and the like), an electrophotographic facsimile, an electrophotographic word processor, and the like.

In an image forming apparatus which employs an electrophotographic image formation process, a process cartridge system has long been employed. According to this system, an electrophotographic photoconductive member, and a single or plurality of processing means, which act on the electrophotographic photoconductive member, are integrated into a form of a cartridge removably mountable in the main assembly of the image forming apparatus. This system enables a user him/her self to maintain the apparatus without relying on a service person, immensely improving the operability of the apparatus. Thus, the process cartridge system has been widely used in the field of an image forming apparatus.

A process cartridge such as the one described above forms an image on a recording medium with the use of a developer contained therein. Therefore, the amount of the developer therein gradually decreases with image formation, eventually to a level below which it fails to form an image satisfactory in quality to the user who purchased the process cartridge. At this point, the process cartridge loses its commercial value.

Thus, it has long been desired to realize a simple method for remanufacturing a process cartridge so that a process cartridge which has lost its commercial value due to the depletion of the developer therein can be marketed again.

SUMMARY OF THE INVENTION

The primary object of the present invention is to provide a simple method for remanufacturing a process cartridge.

Another object of the present invention is to provide a method for remanufacturing a process cartridge, the commercial value of which has been lost due to the consumption of the developer therein to a level below which the process cartridge fails to forms an image satisfactory in quality to a user who has purchased the process cartridge.

Another object of the present invention is to provide a process cartridge disassembling method for remanufacturing a process cartridge, a process cartridge assembling method for remanufacturing a process cartridge, and a positioning/fastening apparatus used with the process cartridge assembling method.

Another object of the present invention is to provide a method for disassembling a process cartridge, which is removably mountable in the main assembly of an electrophotographic image forming apparatus, and comprises: an electrophotographic photoconductive drum; a developing means for developing an electrostatic latent image formed on the electrophotographic photoconductive drum; a drum holding frame for rotationally supporting the electrophotographic photoconductive drum; a developer container for storing the developer to be supplied to the developing means; a developing means holding frame for holding the developing means; a pair of covering members attached to the end surfaces, in terms of the lengthwise direction of the electrophotographic photoconductive member, of the combination of the drum holding frame and developer container, one for one, in a manner to cover virtually the entireties of the end surfaces, comprising: a step in which the joints between the covering members and the combination of the drum holding frame and developer container are cut along the inwardly facing edges of the covering members.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

Referring to FIGS. 1 to 5, the preferred embodiments of the present invention will be described. In the following embodiments, the lengthwise direction means the direction which is perpendicular to the recording medium conveyance direction and parallel to the surface of a recording medium being conveyed.

(Embodiment 1)

(Description of process Cartridge and Apparatus Main Assembly)

Figure 1:
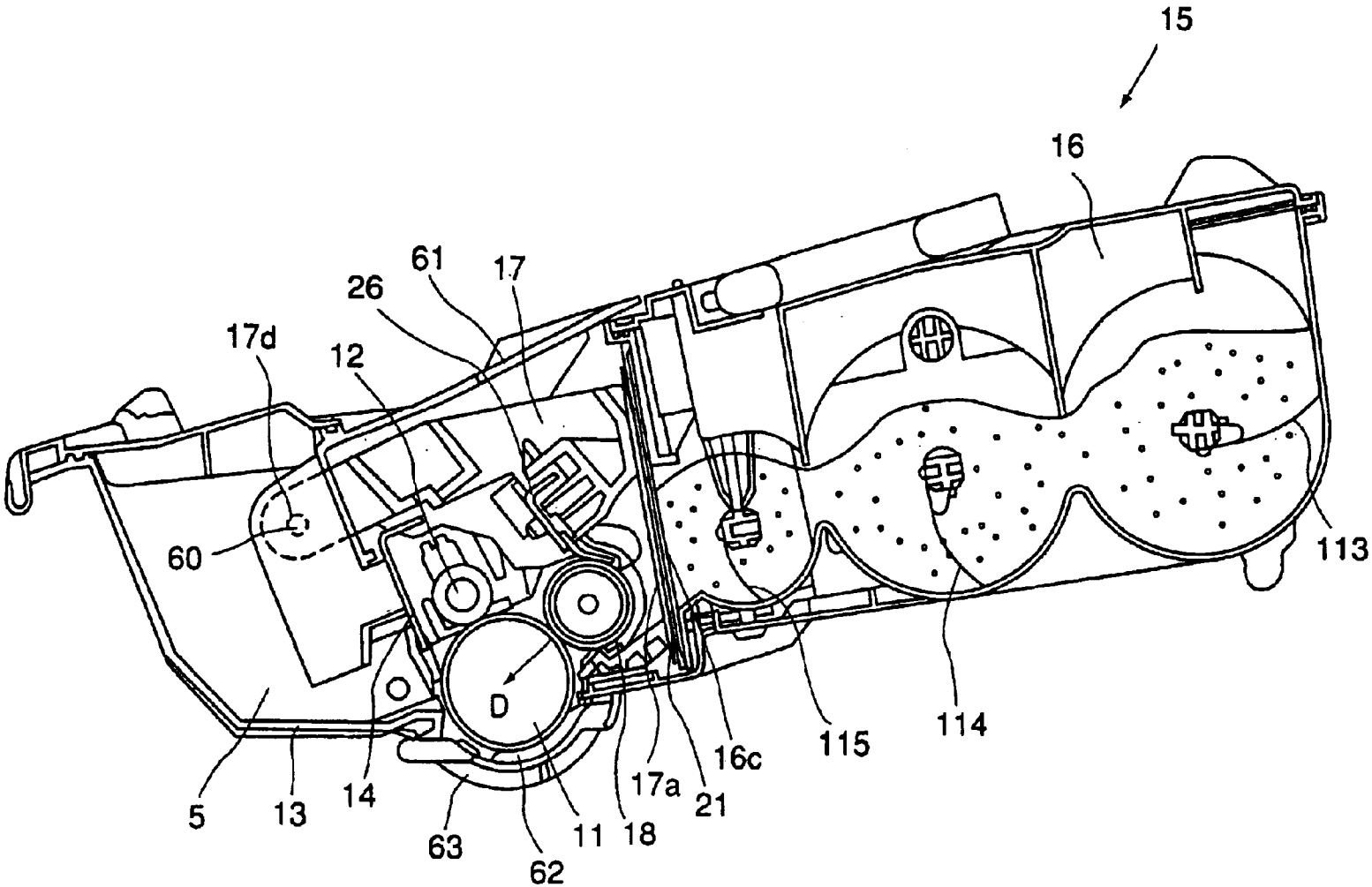
FIG. 1 is a vertical sectional view of a process cartridge.
Figure 2:
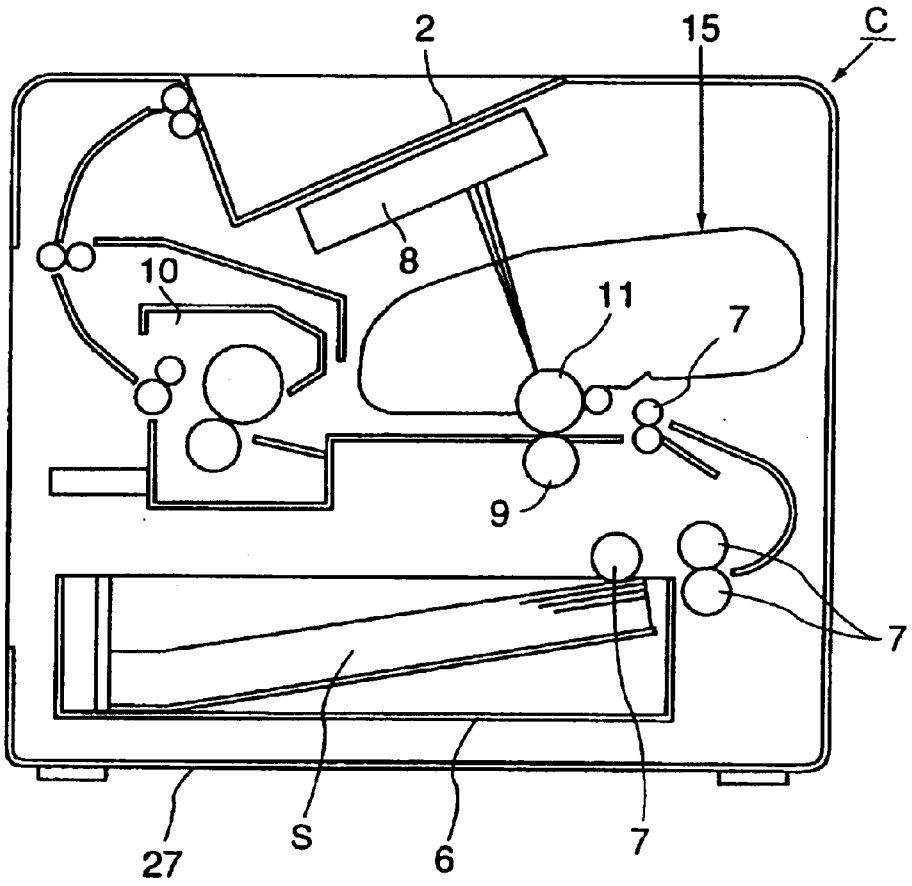
FIG. 2 is a schematic vertical sectional view of an electrophotographic image forming apparatus.

FIG. 1 shows a sectional view of a process cartridge in accordance with the present invention, at a plane perpendicular to its lengthwise direction. FIG. 2 is a sectional view of an image forming apparatus in accordance with the present invention, at a plane perpendicular to the lengthwise direction of the process cartridge. This process cartridge is equipped with an electrophotographic photoconductive member, and a plurality of processing means which act on the electrophotographic photoconductive member. As the processing means, for example, there are a charging means for charging the peripheral surface of the electrophotographic photoconductive member, a developing apparatus for forming a toner image on the electrophotographic photoconductive member, and a cleaning means for removing the residual toner remaining on the peripheral surface of the electrophotographic photoconductive member.

Referring to FIG. 1, the process cartridge 15 in this embodiment comprises: a charging roller 12 as a charging means: a combination of a development roller 18 and a development blade 26, as a developing apparatus; a cleaning blade 14 as a cleaning means; and a housing, or cartridge, in which the charge roller 12, developing apparatus, and cleaning means are integrally disposed around the electrophotographic photoconductive member 11, so that they can be removably mounted in the image forming apparatus main assembly 27 (which hereinafter will be referred to as apparatus main assembly).

This process cartridge 15 is mounted in an electrophotographic image forming apparatus C, such as the one shown in FIG. 2, to be used for an image forming operation. In an image forming operation, a sheet S is conveyed by a pair of conveying rollers 7 from a sheet cassette 6 mounted in the bottom portion of the apparatus main assembly 27. In synchronism with the conveyance of the sheet S, the peripheral surface of the photoconductive drum 11 is selectively exposed by an exposing apparatus 8 through an exposure opening 61, forming a latent image on the peripheral surface of the photoconductive drum 11. Meanwhile, the toner in the toner storage container 16 is coated in a thin layer on the peripheral surface of a development roller 18 by a development blade 26, while being electrically charged by the friction between the toner and blade 26, and a predetermined development bias is applied to the development roller 18. As the development bias is applied, the toner on the peripheral surface of the development roller 18 is transferred onto the peripheral surface of the photoconductive drum 11 in accordance with the latent image, creating a toner image. The thus created toner image is transferred, by the application of bias voltage to a transfer roller 9, onto the sheet S as a recording medium which is being conveyed. Thereafter, the sheet S is conveyed to a fixing apparatus 10, in which the toner image is fixed to the sheet S. After the fixation, the sheet S is discharged into a delivery portion 2 on top of the apparatus main assembly. Meanwhile, the toner which remained on the peripheral surface of the photoconductive drum 11 after the toner image transfer is removed by the cleaning blade 14. The removed toner is moved inward of a removed toner bin 5 by an unshown removed toner moving member.

(Structure of Process Cartridge Frame)

Figure 3:
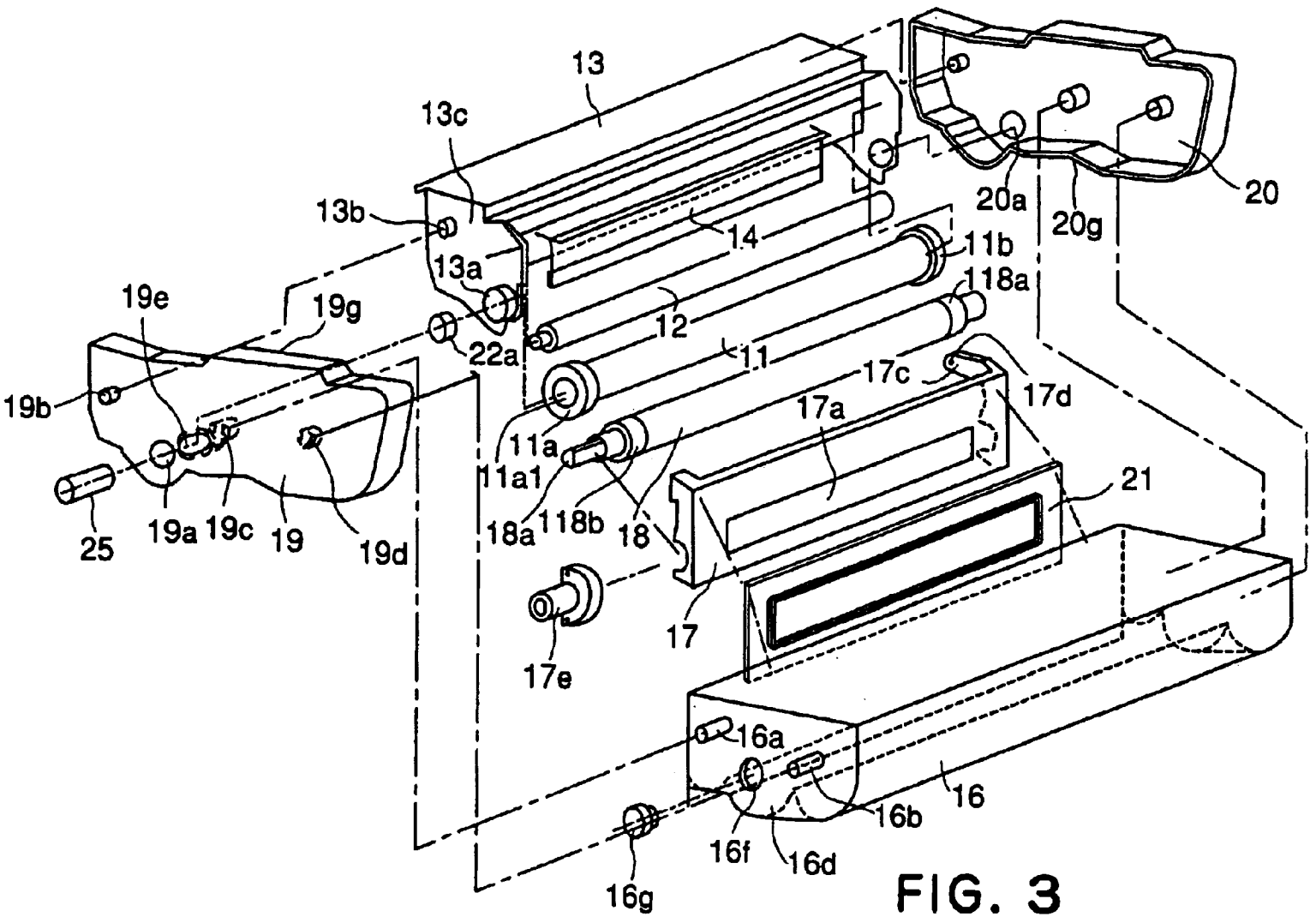
FIG. 3 is an exploded perspective view of the process cartridge.
Figure 4:
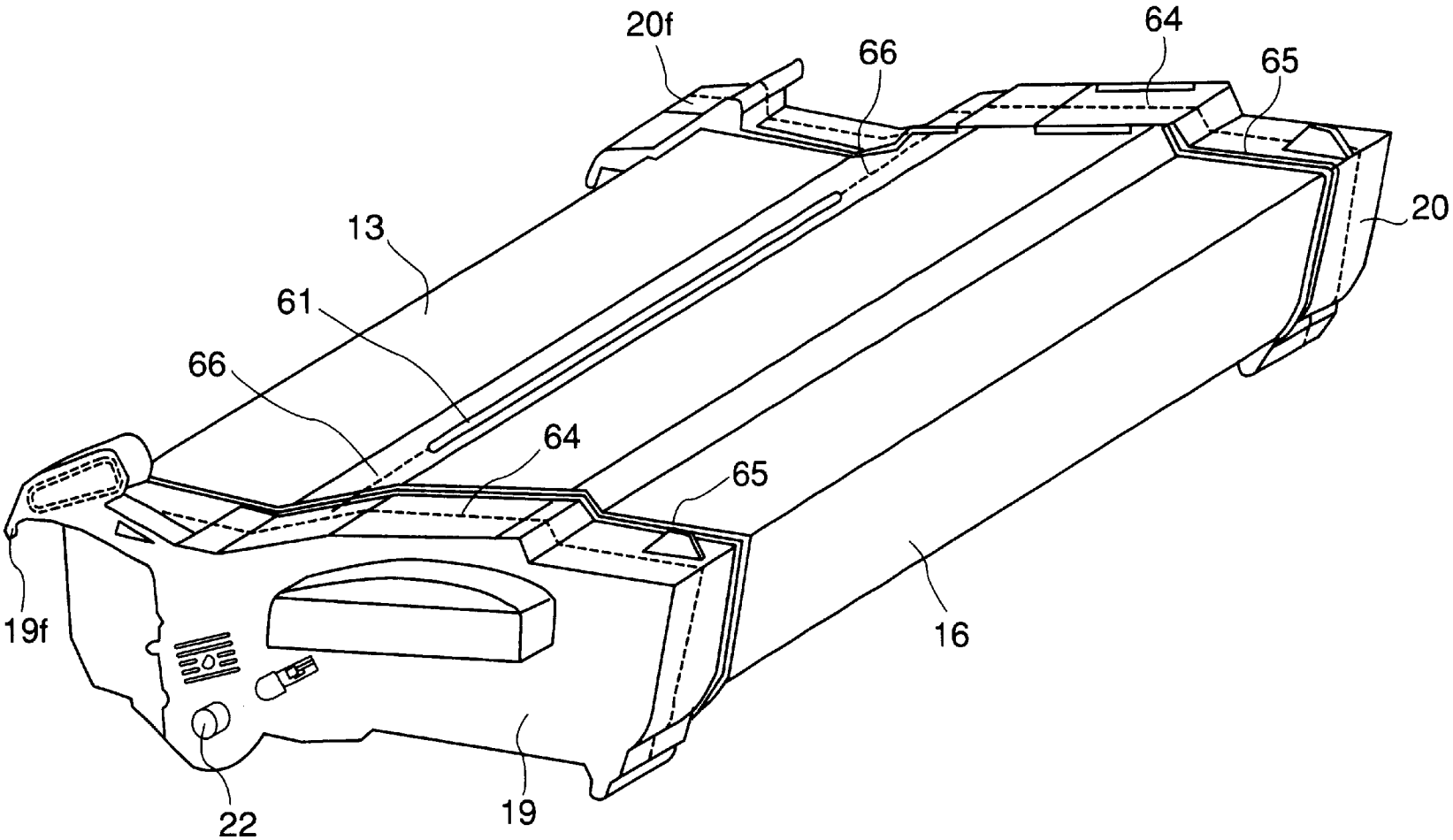
FIG. 4 is a perspective view of the process cartridge in the first embodiment of the present invention, as seen diagonally from above.
Figure 5:
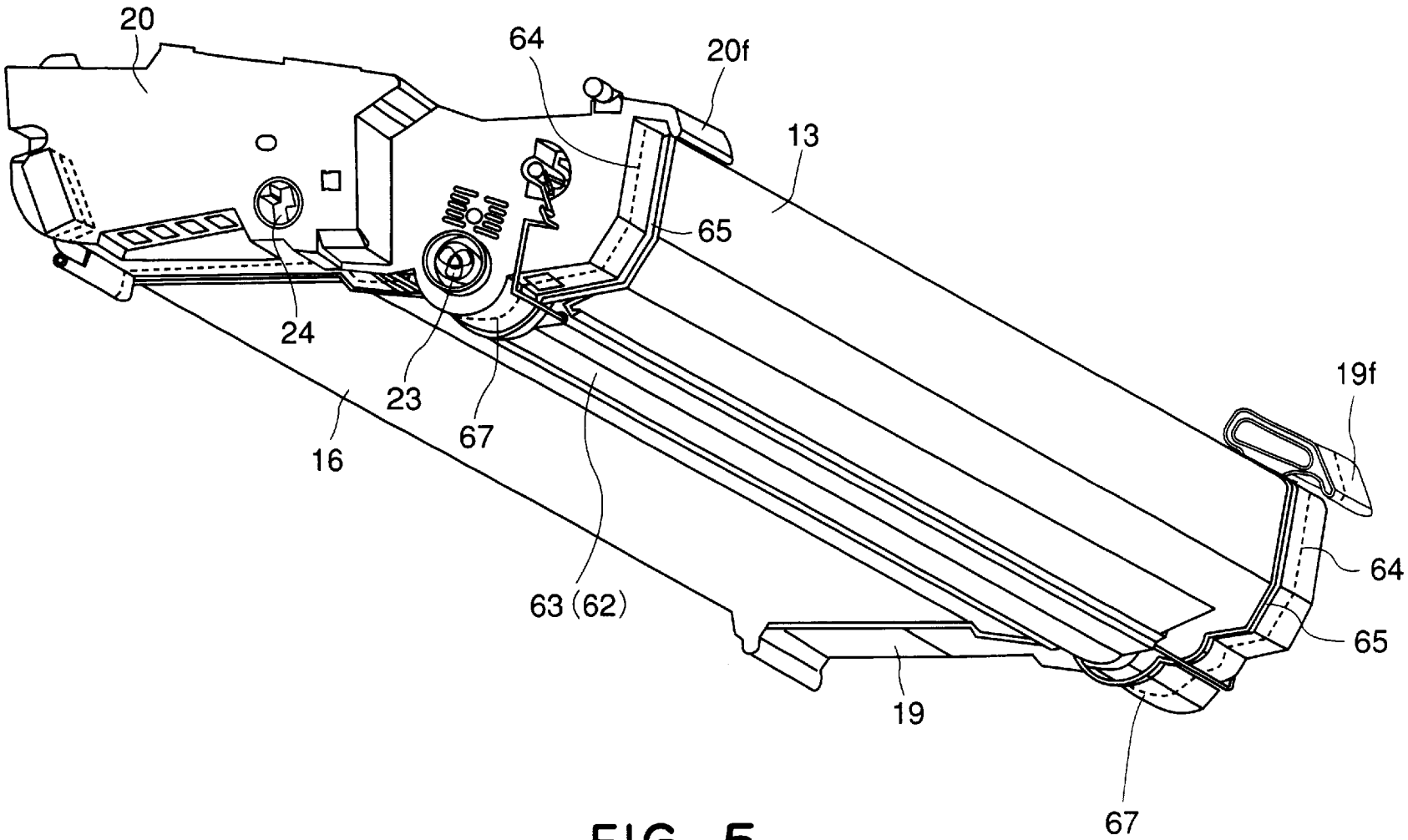
FIG. 5 is a perspective view of the process cartridge in the first embodiment of the present invention, as seen diagonally from below.

FIGS. 3 to 5 are perspective views of the process cartridge 15, for showing the frame structure thereof. FIG. 3 shows the process cartridge 15 before its assembly, and FIGS. 4 and 5 show the cartridge 15 after it assembly. The frame of the cartridge 15 comprises three frames: a cleaning means holding frame 13, in which the drum 11, charge roller 12, and blade 14 are integrally supported; a developing means frame 17, in which the development roller 18, and the development blade (which is not shown in FIG. 3, but is designated by reference code 26 in FIG. 1) are integrally supported; and a toner holding frame, that is, a toner container 16. Further, the cartridge 15 comprises a pair of side covers 19 and 20 for integrally holding these three frames together. The side covers 19 and 20 are secured to the lengthwise ends of the combination of the cleaning means holding frame 13 and toner container 16, whereas the developing means holding frame 17 is supported by the cleaning means holding frame 13.

To the frame 13, the blade 14, charge roller 12, a removed toner moving member, and drum 11 are attached. More specifically, the blade 14 is attached with the use of small screws or the like. As for the charge roller 12, the end portions of the metallic core of the charge roller 12 are attached, with the interposition of bearings (unshown), so that the charge roller 12 is rotationally supported by the frame 13. The unshown removed toner moving member for sending the toner removed by the blade 14, into the removed toner bin 5, is rotationally attached to the frame 13, as shown in FIG. 1. As for the drum 11, its flange portions 11*a* and 11*b* at the lengthwise ends are supported by the frame 13, with the interposition of bearing 22*a* and another bearing, respectively, so that the drum 11 is rotationally supported by the frame 13. The frame 16 contains toner, and stirring members 113, 114, and 115 (FIG. 1) for stirring the toner in the frame 16 while conveying the toner.

The developing means holding frame 17 is supported by the cleaning means holding frame 13.

The side covers 19 and 20 are large enough in size to match the size of the entirety of the cross section of the cartridge 15 perpendicular to the lengthwise direction of the cartridge 15. They constitute the lengthwise end portions of the cassette 15, one for one, integrally supporting the frame 13 and container 16 in such a positional relationship that the axial lines of the holes 19*a* and 20*a* of the side covers 19 and 20 coincide with the axial line of the photoconductive drum 11 supported by the frame 13. On the side cover 19 side of the cartridge 15, that is, on the side of the side cover shown in the drawing, the bearing 22*a* is fitted in the hole 13*a* of the frame 13 (it was pressed into the hole), and an axle 25 rotationally supports one end of the drum 11 by being put through the hole 19*a* of the cover 19, bearing 22*a*, and the center hole 11*a*1 of the flange 11*a*. As the axle 25 is put through the holes, the side cover 19 is properly positioned relative to the combination of the frame 13 and container 16, with the interposition of the bearing 22*a*, being therefore accurately positioned relative to the drum 11. Further, a positioning portion 19*b*, positioned so that it will be as far away as possible from the drum 11 after the attachment of the side cover 19, is fitted into the positioning portion 13*b* on the inward surface of the side wall 13*c* of the frame 13, fixing the attitude of the side cover 19 relative to the frame 13 in terms of the circumferential direction of the drum 11. Then, the cover 19 is secured to the side wall 13*c*, or one of the side walls of the frame 13 in terms of the lengthwise direction. The container 16 is provided with a pair of positioning portions 16*a* and 16*b* which protrude outward from the side wall 16*d*, that is, one of the side walls of the container 16 in terms of the lengthwise direction. These positioning portions 16*a* and 16*b* are fitted into a pair of positioning portions 19*c* and 19*d*, that is, a pair of holes, of the cover 19, fixing the position of the container 16 relative to the side cover 19, and the container 16 and side cover 19 are welded to each other. The cover 20, or the cover for the other lengthwise end of the cartridge 15, is also positioned relative to the container 16 and frame 13, and is secured thereto by welding, as is the cover 19. The developing means holding frame 17 is properly positioned with the use of a method which will be described later. The bearings 22 (22*a* and the other bearing supporting the flange portions 11*a* and 11*b*) also function as members for properly positioning the cartridge 15 relative to the image forming apparatus main assembly 27.

Toner is supplied to the development roller 18 from the frame 16. For this purpose, the container 16 and frame 17 are provided with holes 16*c* (FIG. 1) and 17*a*, respectively. The frame 17 and container 16 are connected by a flexible sealing member 21 placed between them in a manner to connect the holes 17*a* and 16*c*. The attitude of the container 16 is fixed relative to the side covers 19 and 20, whereas the attitude of the frame 17 is fixed relative to the frame 13. Therefore, a gap must be provided between the frame 17 and container 16 in order to compensate for the dimensional manufacture errors. The positional relationship between the cartridge 15 and apparatus main assembly 27 is accurately fixed as the lengthwise end of the frame 13, on the side where the drum 11 is supported, is accurately positioned relative to the cartridge mounting space of the apparatus main assembly 27, when the cartridge 15 is mounted in the apparatus main assembly 27. There is a substantial difference in the weight of the container 16 between when the container 16 contains a large amount of toner and when it is empty. This raises a possibility that the container 16, or covers 19 and 20, will be distorted. Thus, a flexible substance is employed as the material for the sealing member 21.

With the provision of the above described structure, the load from the container 16, which varies depending on the amount of the toner therein, is applied only to the side covers 19 and 20, being prevented from being applied to the development roller 18 even when a large amount of toner is in the container 16. Therefore, the photoconductive drum 11 is not subjected to an unnecessary load. Therefore, it is possible to always obtain a satisfactory image.

(Structure of Developing Means Holding Frame)

Referring to FIGS. 1 and 3, the structure of the developing means holding frame will be described. FIG. 3 is a drawing of the process cartridge prior to its assembly. FIG. 1 is a drawing for describing the pressure applied to the developing means holding frame.

The developing means holding frame 17 contains the development roller 18 as a developer bearing member, a development blade (FIG. 1), and a pair of magnetic seals (unshown). The development roller 18 contains a magnetic roll 18*a*, which is put through the center hole of the development roller 18 and nonrotationally supported by the frame 17 by its lengthwise end portions, with the presence of a gap between the internal surface of the development roller 18 and the peripheral surface of the magnetic roll 18*a*. The development roller 18 itself is rotationally supported by the frame 17 by its lengthwise end portions. For the purpose of supplying electrical power to the development roller 18, an electrical contact point is placed in the hollow of the development roller 18. Further, a pair of spacer rings 118*a* and 118*b* (FIG. 3) for keeping constant the distance between the peripheral surfaces of the drum 11 and development roller 18 are fitted around the lengthwise end portions of the development roller 18, one for one.

The developing means holding frame 17 is supported by the frame 13, being enabled to pivot about the axial line of a hole 17*d* provided in the end portion of the arm portion 17*c*, on the driven side, that is, the lengthwise end of the cartridge 15 from which the cartridge 15 is driven, so that the drum 11 and roller 18 are kept pressured toward each other in a manner to reduce the distance between the axial lines of the drum 11 and roller 18. More specifically, the frame 17 equipped with the roller 18 is attached to the frame 13 by fitting the pin 60 fitted in the hole 17*d* of the developing means holding frame 17, on the driven side, into the hole of the frame 13, on the driven side, in such a manner that the developing means holding frame 17 is enabled to pivot about the axial line of the hole 17*d*. By comparison, the frame 13 and container 16 are simply connected to each other, being not allowed to move relative to each other. Thus, the frame 17 is enabled to move relative to the container 16. Further, one end of an unshown tension spring is hung around a spring hanger, with which one of the lengthwise end portions of the frame 13 is provided, and the other end of the tension spring is hung around the spring hanger of the frame 17, being stretched so that the end of the roller 18 is kept pressured toward the end of the drum 11, on the same side.

On the non-driven side, a bearing 17*e* for rotationally supporting the development roller 18 is attached to the frame 17 so that the axial lines of the cylindrical portion of the bearing 17*e* and development roller 18 coincide, and that the bearing 17*e* is kept pressured toward the axial line of the drum 11.

More specifically, the bearing 17*e* whose cylindrical portion is inserted in a groove 19*e* (which in this embodiment is an elongated hole extending in the radius direction of the drum 11), is enabled to slide in a direction parallel to the radius direction of the drum 11. In other words, the bearing 17*e* also constitutes a member for allowing the one end of the roller 18 to move. Within the groove 19*e*, an unshown compression spring is fitted to keep the bearing 17*e* under pressure while allowing the bearing 17*e* to slide following the groove 19*e*.

The groove 19*e* also bears a role of a positioning member for regulating the direction in which the development roller 18 moves.

The joint between the container 16 and developing means holding frame 17 must be sealed while keeping the holes 16*c* and 17*a* of the container 16 and frame 17, respectively, connected. On the other hand, the frame 17 and container 16 are enabled to move relative to each other. Thus, the sealing member 21 enabled to afford the frame 17 and container 16 a certain amount of movement relative to each other is interposed between the frame 17 and container 16 to prevent toner leakage. The sealing member 21 is attached to the edges of the holes 16*c* and 17*a* in a manner to surround the holes 16*c* and 17*a*. The sealing member 21 is desired to be shaped to prevent its resiliency from interfering the movement of the frame 17; it is desired to have a minimum of one folding line, or to be in the form of bellows.

Although not shown in the drawing, the toner seal for sealing the hole 16*c* is pasted to the lip portion of the hole 16*c* covered with the sealing member 21. One of the lengthwise ends of the toner seal extends outward from between the sealing member 21 and container 16, making it possible for the toner seal to be removed from the outside.

As for the driving system, the drum 11 is provided with a power input coupling 23, which is solidly attached to one of the lengthwise ends of the drum 11, as shown in FIG. 5. The drum 11 and roller 18 are connected by a pair of gears. To one end of the stirring member 114, an power input coupling 24 is solidly fixed. The stirring gears 113, 114, and 115 are connected through an unshown gear train.

The above listed gears are disposed on the same side of the cartridge as the power input couplings 23 and 24, and are covered with cover 20. On the opposite side of the cartridge in terms of the lengthwise direction, that is, the side opposite to where the power output coupling 24 is located, the end of the stirring member 114 is connected to the unshown removed toner moving member within the frame 13, through an unshown gear train, which is covered with the side cover 19.

Referring to FIG. 2, the cartridge 15 is mounted into, or dismounted from, the apparatus main assembly 27 in the following manner. First, an unshown front cover located on the front side of the apparatus main assembly 27 is to be opened. As the cover is opened, an opening through which the cartridge 15 can be put is exposed. The cartridge 15 is inserted into the apparatus main assembly 27 through this opening. After the insertion, the cartridge 15 is to be pivoted to allow the cartridge 15 to descend into the apparatus main assembly 27 so that the drum 11 comes into contact with the transfer roller 9. Then, the unshown front cover of the apparatus main assembly 27 is to be closed. As the front cover is closed, the power output couplings of the apparatus main assembly 27 are moved by the movement of the front cover, being coupled with the power input couplings 23 and 24 on the cartridge side. In order to dismount the cartridge 15 from the apparatus main assembly 27, the above described steps are to be followed in reverse.

The aforementioned exposure opening 61 is in the top surface of the frame 13. Here, the top surface means the surface which constitutes the top surface when the cartridge 15 is in the apparatus main assembly 27. As for the transfer opening 62 for toner image transfer, it is between the frames 13 and 17.

The frame 13, the container 16, the frame 17, and the side covers 19 and 20 are formed of shock resistant polystyrene HIPS, for example.

The covers 19 and 20 are shaped like a lidless container, being open on the sides which face the side walls 16*d* and 13*c*, in terms of the lengthwise direction, of the container 16 and frame 13, respectively. The rim portions 19*g* and 20*g* of the covers 19 and 20 are joined with the edges of the side walls 16*d* and 13*c* of the container 16 and frame 13, respectively, after the following steps. First, after the mounting of the development roller 18 and development blade 26 into the frame 13, and the drum 11, the charge roller 12, the cleaning blade 14, into the frame 13, the frame 17 is connected to the frame 13. Further, the stirring members 113, 114, and 115 are mounted into the container 16, and the hole 16*c* is hermetically sealed with the unshown toner seal. Then, toner is filled into the container 16 through the toner inlet 16*f* of the side wall 16*d* of the container 16. Then, the toner inlet 16*f* is plugged with a toner cap 16*g*, completing the filling of the toner. After the filling of the toner, the container 16 is joined with the frame 17, with the interposition of the sealing member 21 which allows the frames 13 and 17 to move relative to each other after the joining. Thereafter, the aforementioned gears of the driving system are attached. Next, the frame 13, container 16, and side covers 19 and 20, are set in the jig which keeps them accurately positioned relative to each other in terms of their predetermined relationship in a process cartridge into which they will be integrated; in other words, they are temporarily assembled on the jig. Then, melted resin is poured into the grooves provided in the side covers 19 and 20, along the edges 19*g* and 20*g*, through the resin paths provided in advance in the side covers 19 and 20. As a result, the covers 19 and 20 are welded to the frames 13 and container 16 by the resin. The joints 65 created by the above described process are shown in FIGS. 4 and 5. The employment of this type of resin based joining method does not deform the frames as does the employment of a jointing method which uses screws. It creates a stronger joint, and also affords the side cover a larger interior space, making component arrangement easier.

The cartridge 15 is provided with a drum shutter 63, which keeps the transfer opening 62 covered when the cartridge 15 is out of the apparatus main assembly 27. As described before, the transfer opening 62 is an opening for allowing the drum 11 to be placed in contact with the transfer roller 9. The drum shutter 63 is held to the side covers 19 and 20 by the mechanical link.

As the toner within the container 16 is depleted due to consumption, it is displayed on the monitor of the apparatus main assembly 27 that there is no toner in the cartridge 15. Then, this toner depleted cartridge 15 is recovered for cartridge remanufacture.

(Cartridge Disassembling Method)

Next, referring to FIGS. 4 and 5, a method for disassembling the above described process cartridge will be described.

First, the drum shutter 63 is to be removed.

In FIGS. 4 and 5, a theoretical cutting line 64 follows the circumference of the side cover 19 (20), near the joint 65 between the side cover 19 (20) and the combination of the frame 13 and container 16.

By cutting the cartridge 15 along these cutting lines, the side covers 19 and 20 can be removed from the cartridge 15, leaving the joint 65 on the side of the main portion of the cartridge 15.

After the removal of the side covers 19 and 20 in the above described manner, an unshown sleeve gear attached to the end of the development roller 18, and unshown gears for transmitting a driving force to the toner conveying member 113 and 114 within the container 16, or the like, can be removed.

Also, after the removal of the side covers 19 and 20, the cartridge 15 is to be cut along a theoretical cutting line 66 connecting the lengthwise end of the exposure opening 61 and the above described cutting line 64, and along a cutting line 67 connecting the lengthwise end of the transfer opening 62 and the above described cutting line 64. With this procedure, the frame 13 can be virtually separated from the combination of the frame 17 and container 16, with the drum 11, the cleaning blade 14, the charge roller 12, and the like left attached to the frame 13, and the development roller 18, the development blade 26, and the like, left attached to the combination of the frame 17 and the container 16.

Next, the parallel pin 60 with which the frame 17 is pivotally supported by the frame 13 is to be removed. With this procedure, the frame 13 is completely separated from the combination of the frame 17 and the container 16.

Then, the drum 11, the blade 14, the charge roller 12, and the like, are detached from the frame 13, and the development roller 18, the development blade 26, magnetic seals (unshown), and the like, are detached from the frame 17.

Although it was described above as the disassembly order that the parallel pin 60 is to be removed after the cutting of the cartridge along the cutting lines 66 and 67, the order may be reversed. Further, the removal of the gears and the like are possible anytime after the cutting along the cutting line 64. For example, the unshown sleeve gears attached to the lengthwise ends of the development roller 18 may be detached immediately after the cutting along the cutting line 64, whereas the gears and the like (components which are partially in the holes of the wall of the toner container 16) for transmitting the driving force to the stirring members 113, 114, and 115, and the like, may be removed after the complete separation of the frame 13 from the combination of the frame 17 and container 16. In other words, the different groups of gears and the like may be removed at the different stages of cartridge disassembly. The employment of the above described disassembly procedure reduces the possibility that toner will scatter during the disassembly.

As for the cutting tools, an ultrasonic cutter, a circular saw, or the like, can be used.

Incidentally, when recycling the cartridge material without recycling the cartridge frame as it is, the projecting portions (19*f*, 20*f*, and the like) of the covers 19 and 20 may be cut off before cutting the cartridge along the cutting line 64, in order to make it easier to cut the cartridge along the cutting line 64 and the like.

As described above, according to the cartridge disassembling method in this embodiment of the present invention, the side covers are removed from the cartridge main structure by cutting the cartridge along predetermined cutting lines. Therefore, the driving force transmitting components, such as gears, can be easily removed for component recycling. Further, even when pulverizing and melting the cartridge components in order to recycle them as the cartridge material, that is, the various plastics, for the cartridge frame, the gears, and the like, the components can be more easily classified to reduce the recycling cost, and also to produce as pure cartridge materials as possible from the recycled cartridge components.

Further, the procedure for cutting the cartridge along the cutting line connecting the exposure opening and the cut portions (cutting line 64), as well as the cutting line connecting the transfer opening and the cut portions (cutting line 64), is carried out after the procedure for removing virtually the entireties of the side covers 19 and 20, reducing the cutting time. Further, practically, the cartridge is cut into the cleaning means holding frame side, and the developing means holding frame/toner container combination side, virtually eliminating the possibility that the photoconductive drum, the development roller, and the like will be damaged during the disassembly, and also reducing the possibility that the waste toner in the cleaning means holding frame, and the toner remaining in the developing means holding frame and toner container, will be allowed to scatter.

(Embodiment 2)

In this embodiment, another process cartridge disassembling method will be described. A process cartridge compatible with the disassembling method in this embodiment, and a process cartridge compatible with the disassembling method in the first embodiment, are identical when they are new.

(Process Cartridge Disassembling Method)

Figure 6:
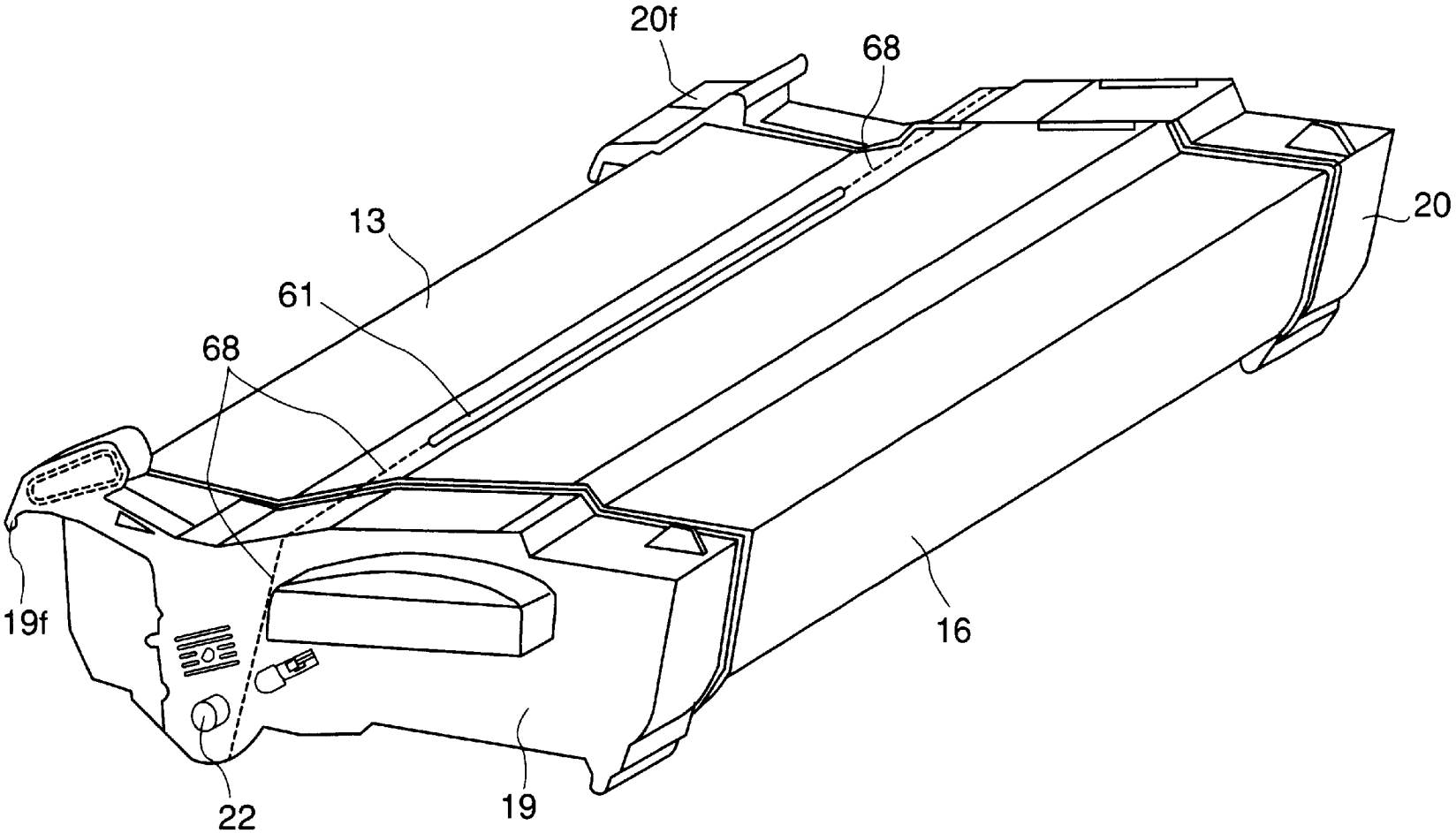
FIG. 6 is a perspective view of the process cartridge in the second embodiment of the present invention, as seen diagonally from above.
Figure 7:
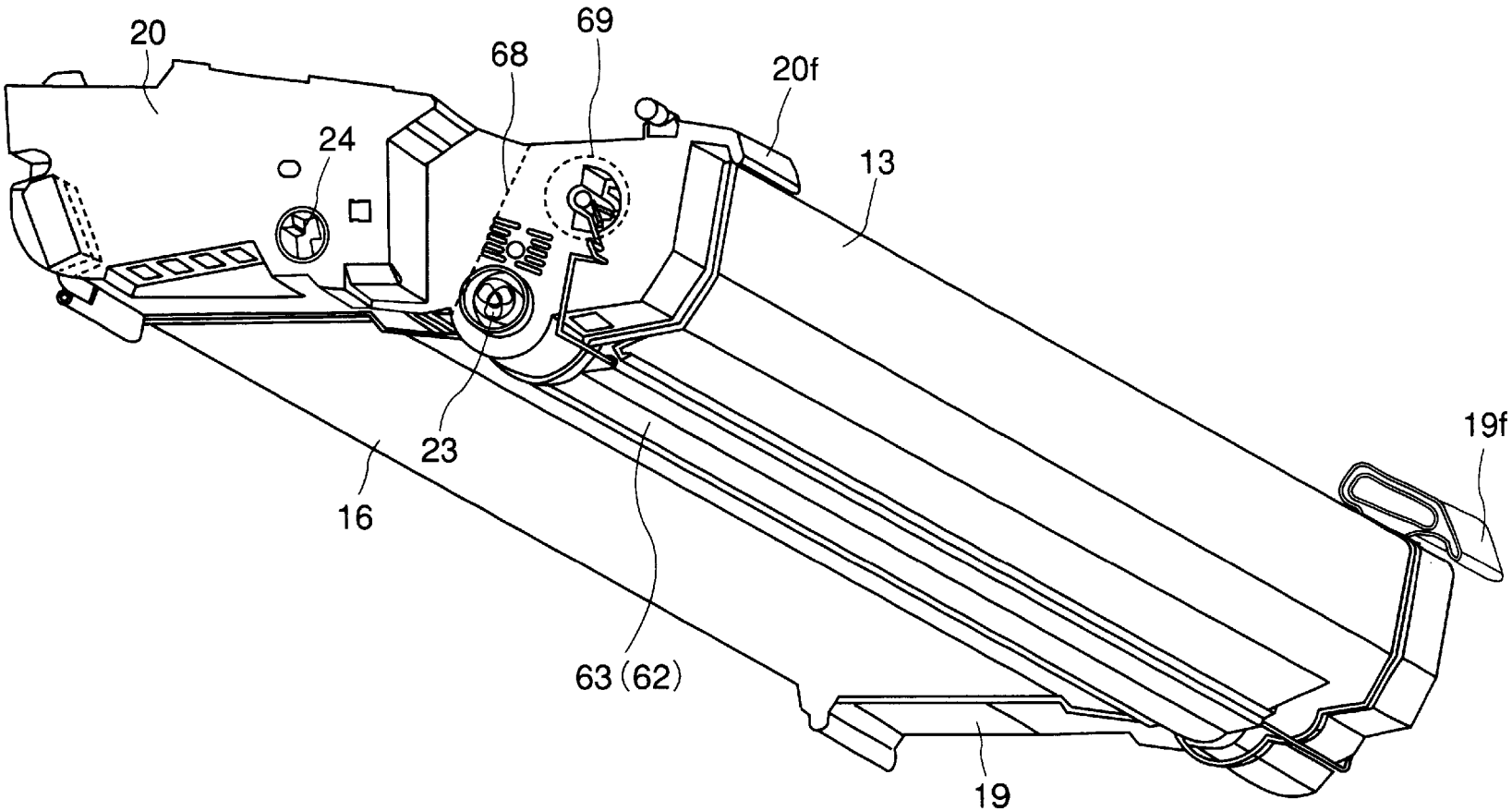
FIG. 7 is a perspective view of the process cartridge in the second embodiment of the present invention, as seen diagonally from below.

Referring to FIGS. 6 and 7, the process cartridge disassembling method in this embodiment will be described. In FIGS. 6 and 7, theoretical cutting lines 68 extend from the lengthwise ends of the exposure opening 61, one for one, in the lengthwise direction, to the corresponding outward edges of the covers 19 and 20 across the horizontal portions of the frame 13 and the horizontal portions of the covers 19 and 17, downward to the bottom edges of the covers 19 and 20 across the vertical portions of the covers 19 and 20, and reach the transfer opening 62 across the bottom surface of the covers 19 and 20 (portions of the cutting lines across the bottom surfaces of the covers 19 and 20 are not visible because of the manner in which the cartridge is positioned in the drawings). These cutting lines 68 are drawn approximately between the drum 11 and development roller 18. Cutting the cartridge along these cutting lines 68 makes it possible to separate the frame 13 from the combination of the frame 17 and container 16, while keeping the drum 11, the blade 14, the charge roller 12, and the like attached within the frame 13, and the development roller 18, the development blade 16, and the like, attached within the combination side.

After the cutting of the cartridge along the cutting line 68, the cartridge is cut along a theoretical cutting line 69 (circular) to make a hole in the cover 20 as shown in FIG. 7. The position of this hole coincides with that of the parallel pin 60 which pivotally holds the frame 17 to the frame 13. Making a hole by cutting the cartridge along the cutting line 69 makes it possible to access the parallel pin 60 through the hole, allowing the pin 60 to be removed through the hole.

The removal of the parallel pin 60 makes it possible to completely separate the frame 13 from the combination of the frame 17 and container 16.

After the complete separation of the frame 13 from the combination of the frame 17 and container 16, the drum 11, the cleaning blade 14, the charge roller 12, and the like are taken out of the frame 13, and the development roller 18, the development blade 16, unshown magnetic seals, and the like are taken out of the developing means holding frame 17.

As for the cutting tools, an ultrasonic cutter, a circular saw, or the like, can be used.

As described above, according to the process cartridge disassembling method in this embodiment of the present invention, a cartridge is cut only along the lines which connect the corresponding lengthwise ends of the exposure opening and the transfer opening. Therefore, the cutting distance is shorter, reducing therefore the disassembling time.

Further, the cartridge is cut into the cleaning means holding frame side, and the developing means holding frame/toner container combination side, eliminating the possibility that the photoconductive drum, the development roller, and the like will be damaged during the disassembly, and also reducing the possibility that the waste toner in the cleaning means holding frame, and the toner remaining in the developing means holding frame and the toner container, will be allowed to scatter. The waste toner and the remaining toner can be easily removed after the removal of the photoconductive drum, the development roller, and the like.

(Embodiment 3)

The process cartridge referenced in this third embodiment of the present invention, and the process cartridge referenced in the first embodiment of the present invention are identical, when they are new.

Hereinafter, the process cartridge remanufacturing method, the process cartridge disassembling method, the process cartridge assembling method, the positioning/fastening apparatus, and the process cartridge itself, will be described with reference to the appended drawings.

This third embodiment of the present invention relates to a method for disassembling a process cartridge by cutting the cartridge frame into a plurality of sections, a method for reassembling a process cartridge by recombining the plurality of cartridge sections resulting from the cutting of the cartridge frame, a process cartridge remanufacturing method comprising the above mentioned cartridge disassembling method and the cartridge reassembling method, a positioning/fastening apparatus for precisely recombining the plurality of frame sections resulting from the cutting of the cartridge frame, and a process cartridge compatible with the above methods and apparatus.

(Disassembling Method)

Here, referring to FIGS. 8 to 14, the cartridge disassembling method in this embodiment of the present invention will be described.

Figure 8:
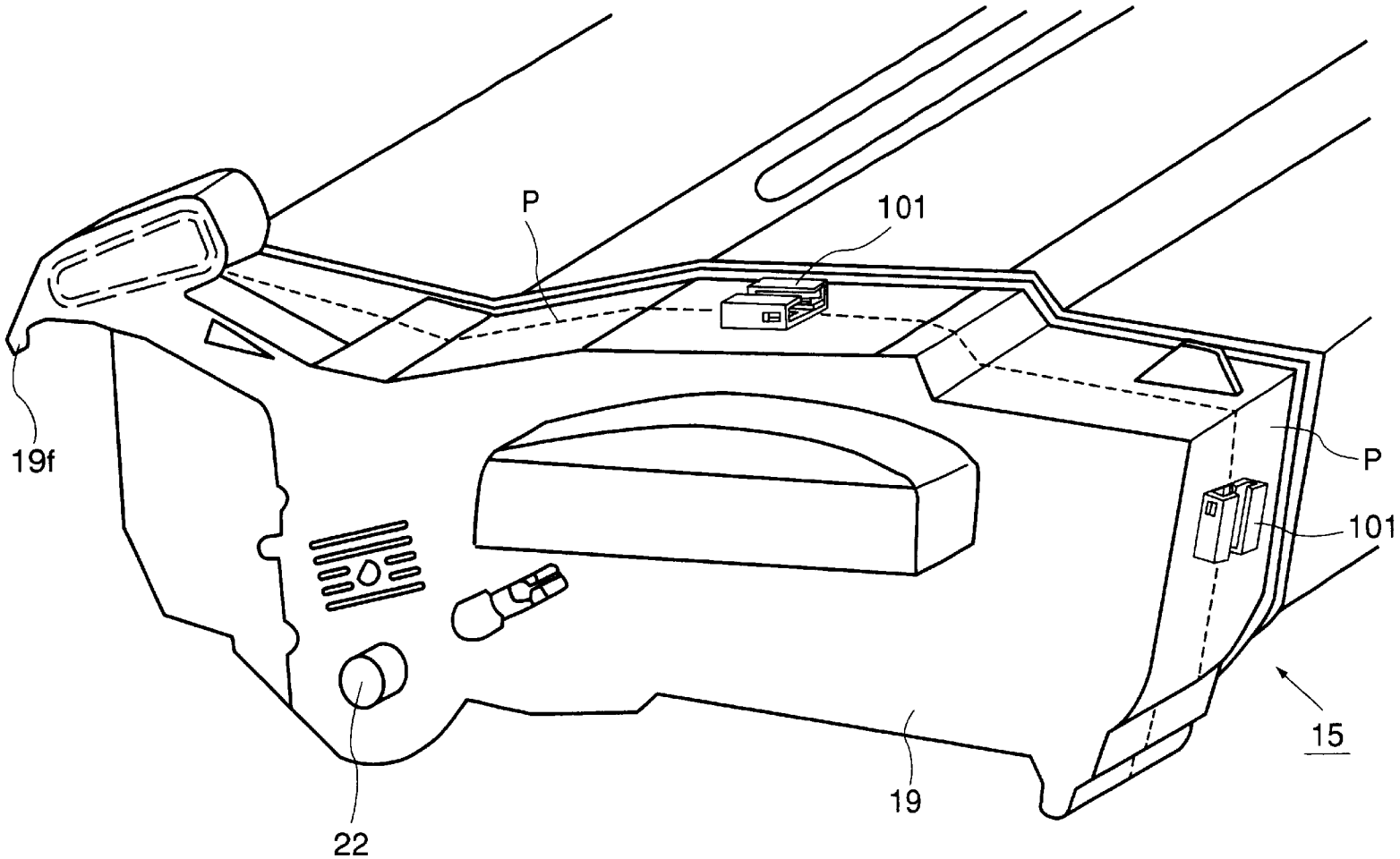
FIG. 8 is a perspective view of the process cartridge in the third embodiment of the present invention.
Figure 9:
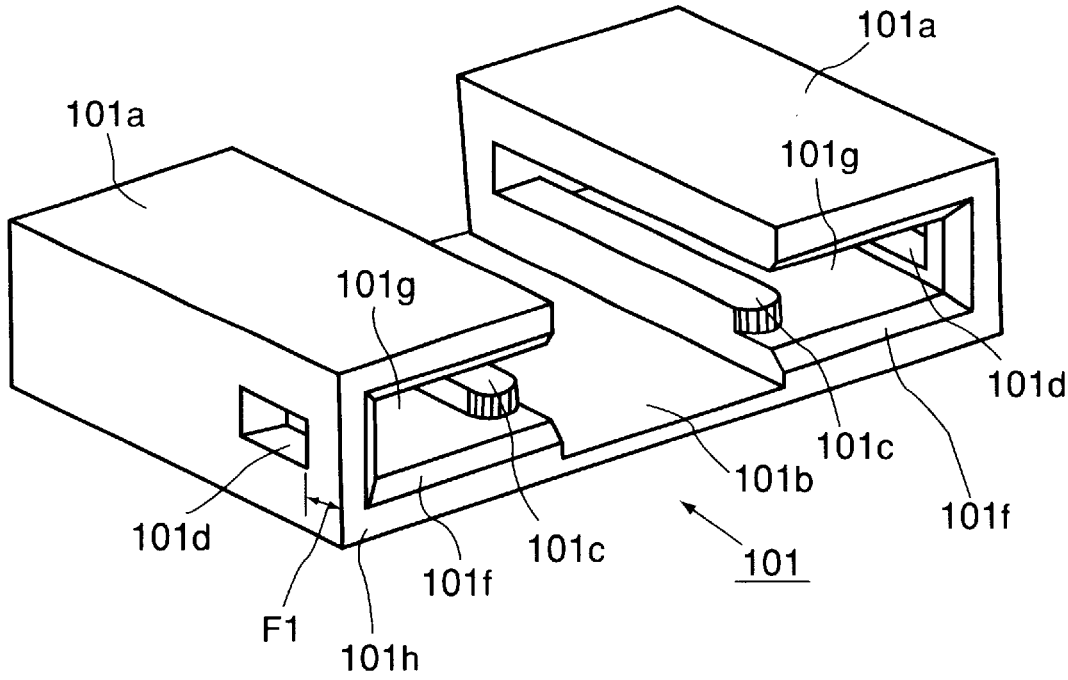
FIG. 9 is a perspective view of the positioning member in the third embodiment of the present invention, as seen diagonally from above.
Figure 10:
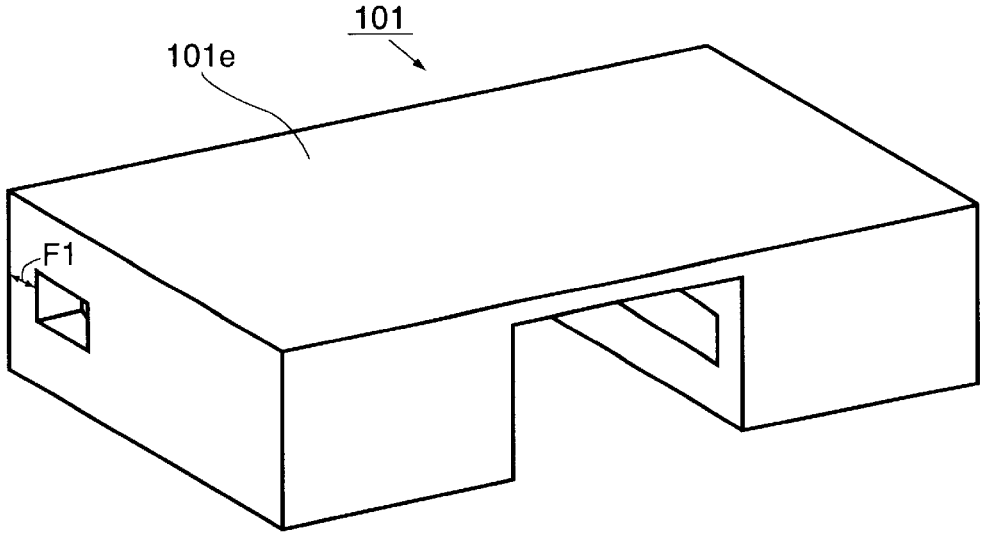
FIG. 10 is a perspective view of the inverted positioning member in the third embodiment of the present invention.
Figure 11:
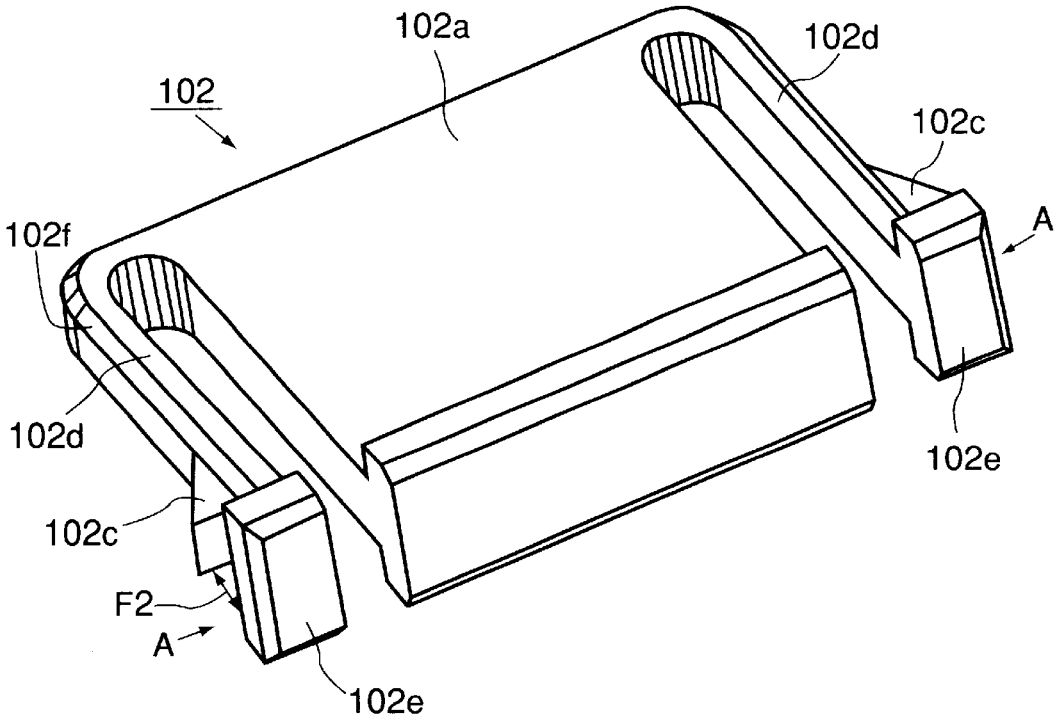
FIG. 11 is a perspective view of a fastening member.
Figure 12:
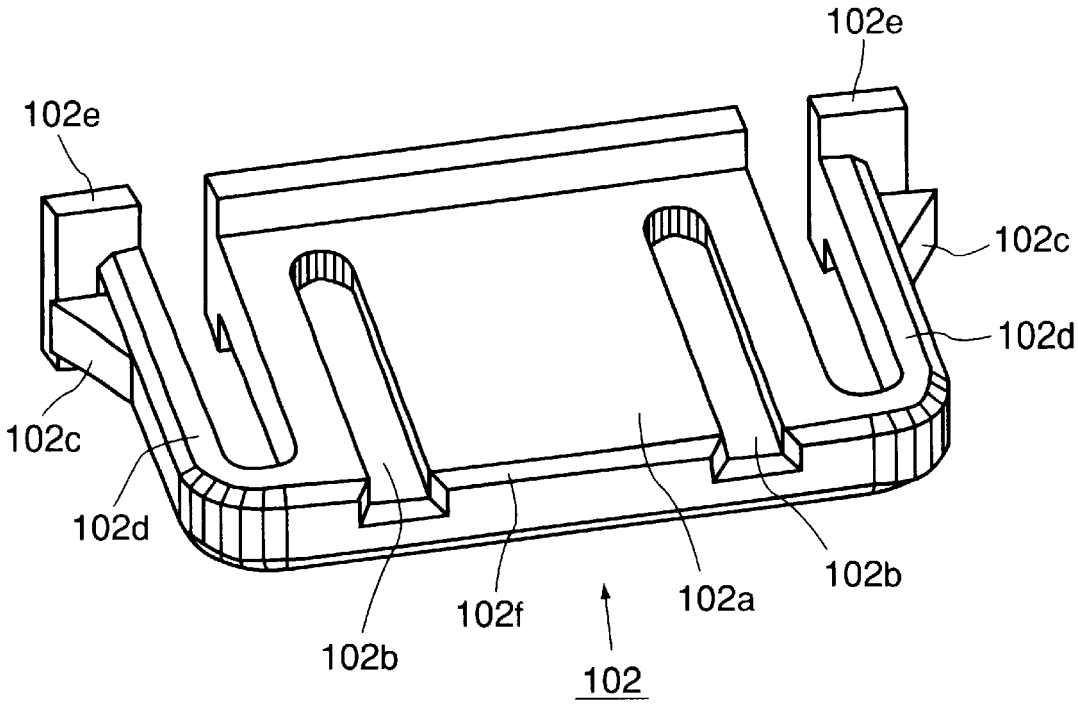
FIG. 12 is a perspective view of the inverted fastening member.

FIG. 8 is a perspective view of the lengthwise end portion of the process cartridge on the cover 19 side, after the pasting of a plurality of single-piece positioning members to the cartridge. FIGS. 9 and 10 are enlarged perspective views of a single-piece positioning member. FIGS. 11 and 12 are perspective views of a fastening member engaged with the positioning member, shown in FIGS. 9 and 10, when assembling a process cartridge. In this embodiment, a fastening member is not necessary when disassembling a process cartridge. However, in order to make it easier to understand the cartridge disassembling method in this embodiment, the positioning member and fastening member shown in FIGS. 9, 10, 11, and 12 will be described first.

Referring to FIG. 9, each single-piece positioning member 101 has a pair of receptacle portions 101*a* having a gap 101*g* into which the main portion of a fastening member 102 is inserted, and a connective portion 101*b* which connects the pair of the receptacle portions 101*a*. The thickness of the main portion 102*a* of the fastening member 102 is the same as the height (distance between top and bottom walls of receptacle portion) of the gap of the receptacle portion of the single-piece positioning member 101. Each receptacle portion 101*a* has a projection 101*c* for properly positioning the fastening member 102, and a hole 101*d* in which the locking projection of the fastening member 102 engages. Next, referring to FIG. 10 which shows the back side of the single-piece positioning member 101, a referential code 101*e* denotes the surface by which the single-piece positioning member is attached to the cover 19 or 20 of the cartridge 15. The lip portions of the walls of the receptacle portion 101*a*, which surrounds the gap 101*g* into which the main portion 102*a* of the fastening member 102 is inserted are chamfered to make easier the insertion of the main portion 102*a*. A referential code F1 denotes the distance between the end surfaces 101*h* of the walls surrounding the gap 101*g*, and the hole 101*d*.

FIG. 11 is a perspective view of a fastening member 102 as seen from the direction corresponding to the direction from which the single-piece positioning member 101 is seen in FIG. 9. FIG. 12 is a perspective view of the fastening member 102 as seen from the direction corresponding to the direction from which the single-piece positioning member 101 is seen in FIG. 10. The main portion 102*a* of the fastening member 102 is provided with a pair of recesses 102*b* which perfectly correspond to the position of the single piece positioning member 101, and a pair of claw portions 102*c* which latch into the corresponding holes 101*d* of the single-piece positioning member 101. The pair of arm portions 102*d* of the fastening member 102 are the portions that elastically deform to allow the pair of claw portions 102*c* to fit into the holes 101*d*. They can be elastically deformed by grasping the fastening member by the handle portions 102*e* in a manner to press the arm portions 102*d* in the direction indicated by an arrow mark A in FIG. 11. The chamfered surface 102*f* of the fastening member 102 is provided for making easier the insertion of the fastening member 102 into the single-piece positioning member 101. The distance F2 between the handle portion 102*e* and claw portion 102*c* is the same as the distance F1 between the end surfaces 101*h* of the walls surrounding the gap 101*g*, and the hole 101*d*, of the single-piece positioning member 101.

As the main portion 102*a* of the fastening member 102 is pushed into the gaps 101*g* of the single-piece positioning member 101, the projections 101*c* of the single-piece positioning member 101 fit into the recesses 102*b* of the fastening member 102, and guide the fastening member 102. After the contact between the claw portions 102*c* of the fastening members 102 and the chamfered surface 101*f* of the single-piece positioning member 101, the fastening member 102 is to be pushed further into the single-piece positioning member 101, while squeezing the handle portions 102*e* of the fastening member 102 in the arrow A direction against the resiliency of the arm portions 102*d*, until the trailing end of each handle portion 102*e* becomes flush with the end surfaces 101*h* of the walls surrounding the gap 101*g* of the single-piece positioning member 101. The squeezing is to be stopped as the trailing end of each handle portion 102*e* becomes flush with the end surfaces 101*h*. As the handles portions 102*e* are released from the squeezing fingers, the claw portions 102*c* fit into the corresponding holes 101*d* of the single-piece positioning member 101.

Figure 13:
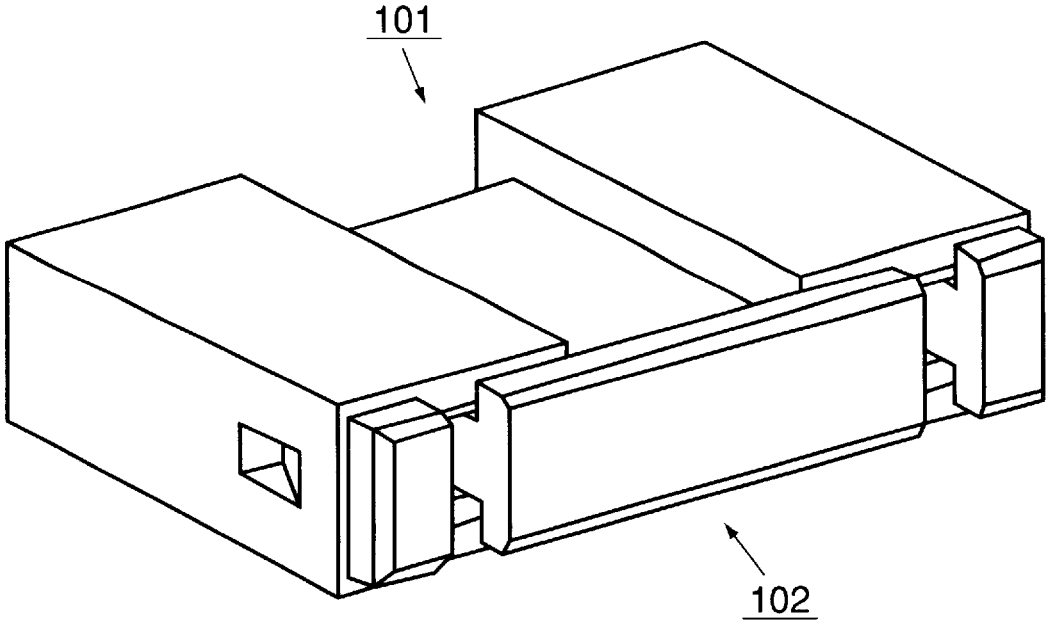
FIG. 13 is a perspective view of the assembled positioning/fastening apparatus.

FIG. 13 is a perspective view of the single-piece positioning member 101 and fastening member 102 after the latter has been completely inserted into the former. Giving the single-piece positioning member 101 and fastening member the above described configurations and measurements, the two members are not allowed to move in any direction relative to each other: in other words, the two are rigidly engaged.

Figure 14:
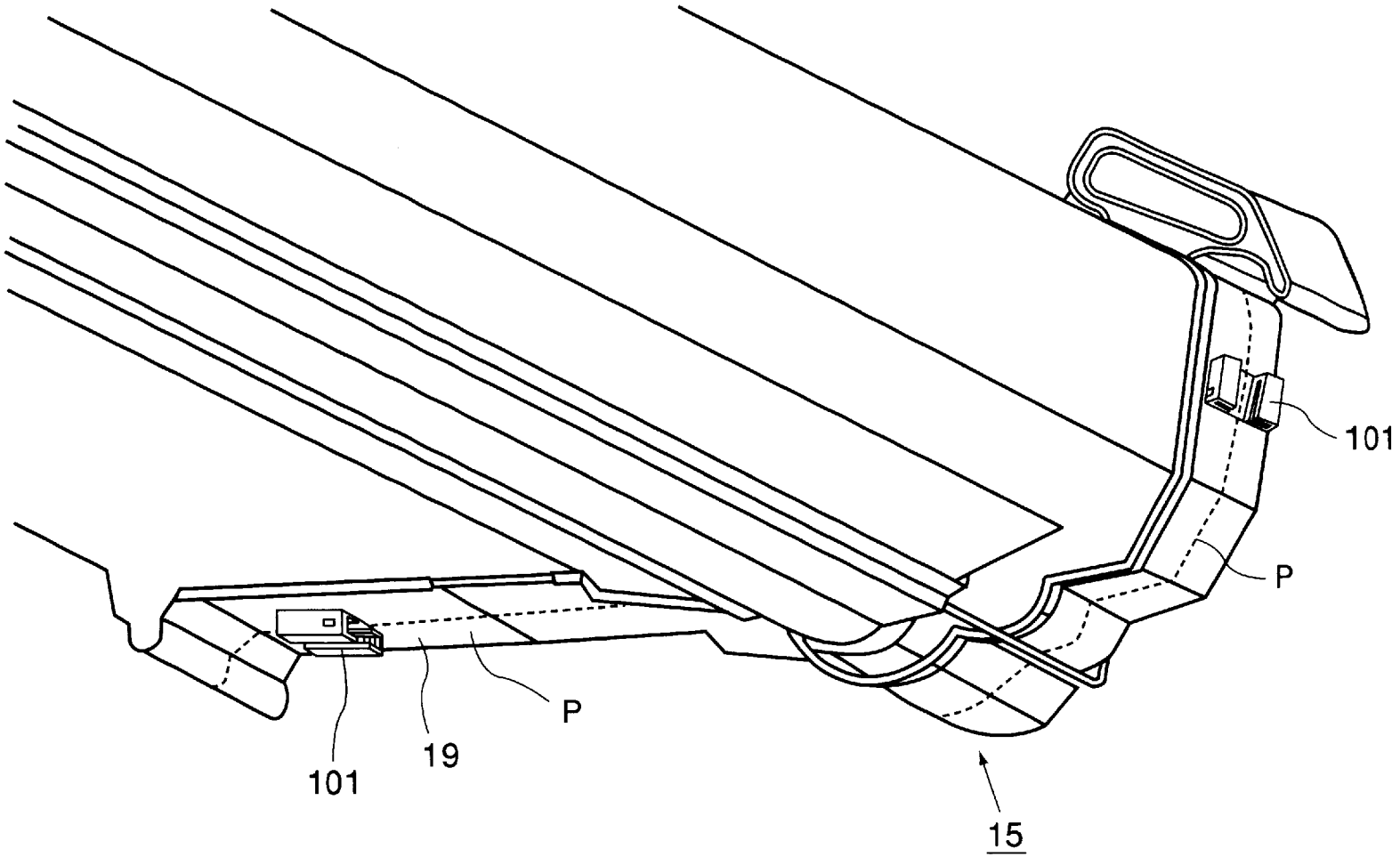
FIG. 14 is a perspective view of one of the lengthwise ends of the process cartridge, to the side cover of which positioning members have been attached.

FIG. 8 is a perspective view of the lengthwise end portion of the cartridge, on the cover 19 side, after the attachment of a pair of the above described single-piece positioning members 101 to the side covers 19 and 20. In this embodiment, the single-piece positioning members 101 are adhered to the covers 19 and 20 by the bottom surfaces 101*e* of the positioning members 101. After the attachment of the single-piece positioning members 101 to the covers 19 and 20, the covers 19 and 20, and the single-piece positioning members 101, are cut along a theoretical cutting line (indicated by dotted line P in the drawing), which runs between the pair of the receptacle portions 101*a*. FIG. 14 shows the back side of the cartridge 15. The covers 19 and 20 and the single-piece positioning members 101, are also cut along the theoretical line P (indicated by dotted line P in the drawing), that is, the continuation of the theoretical line P in FIG. 8. As a result, each single-piece positioning member 101 is cut into two symmetrical halves with a single receptacle portion, at the middle of the connective portion 101*b*, so that one of the pair of receptacle portions 101*a* remains on the portion of the side cover 19 (20) on the main structure side, that is, the inward side with respect to the theoretical line P, and the other receptacle portion remains on the portion of the side cover 19 (20) on the outward side with respect to the theoretical line P. Similarly on the cover 20 side, each single-piece positioning member 101 is cut in the same manner as it is on the cover 19 side. As a result, the cover 19 (20) is divided into a portion which remains attached to the main section of the cartridge, and a portion detached from the main section of the cartridge. As for the cutting tools, an ultrasonic cutter, a circular saw, or the like, can be used.

Next, the portions of the cartridge on the outward side of the exposure opening 61 in terms of the lengthwise direction are cut along the theoretical cutting line 66 in the first embodiment, and the portions of the cartridge on the outward side of the transfer opening 62 in terms of the lengthwise direction are cut along the theoretical cutting line 67 in the first embodiment. Thereafter, the frames 13 and 17 are separated from each other.

Then, the drum 11, the cleaning blade 14, the charge roller 12, and the like are detached from the frame 13, and the development roller 18, the development blade 16, unshown magnetic seals, and the like are detached from the developing means holding frame 17.

Figure 21:
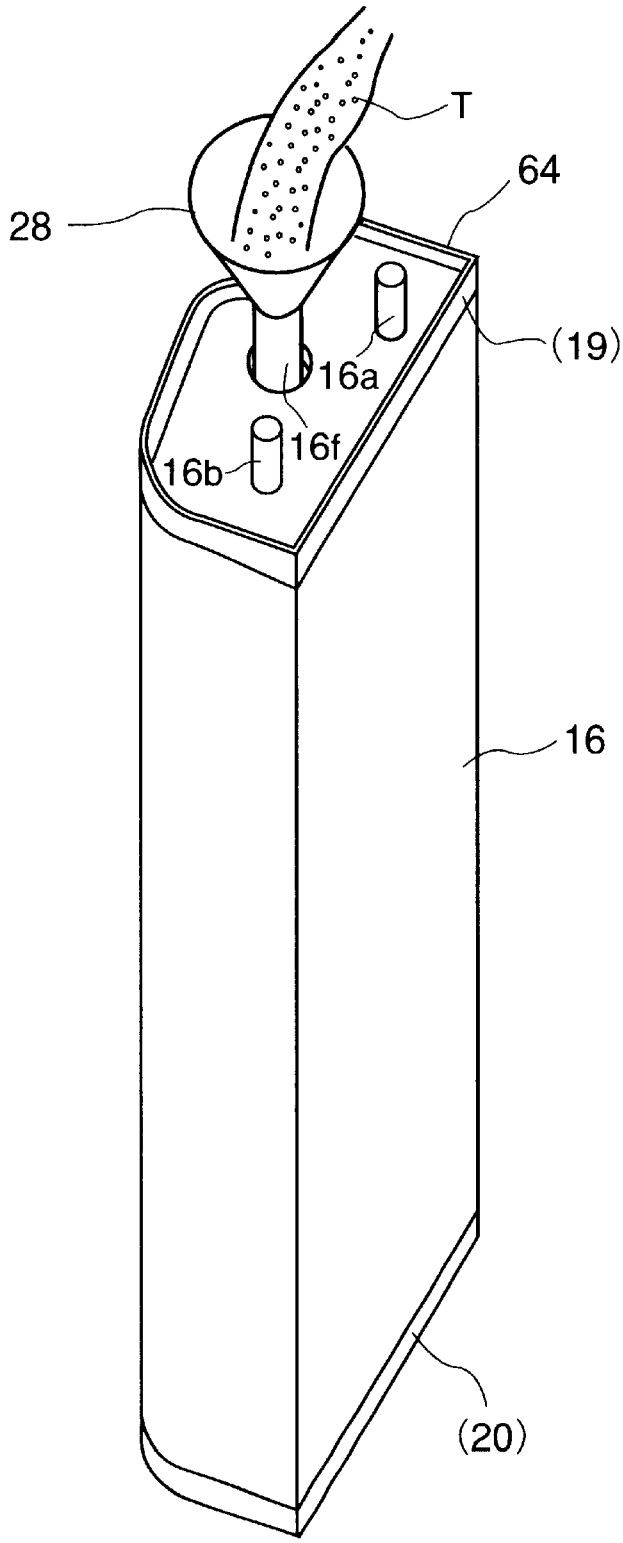
FIG. 21 is a perspective view illustrating a toner supply operation.

After the detachment of various components, for example, the drum 11, the development roller 18, the charge roller 12, the cleaning blade 14, the development blade 26, and the like, they are cleaned, and examined for their recyclability. The nonrecyclables are put aside for material recycling. Then, the recyclables are reattached to the corresponding frames, along with new replacement components for the nonrecyclables. More specifically, the drum 11, the charge roller 12, the cleaning blade 14, and the like are reattached to the frame 13, and the development roller 18 and the development blade 16 are reattached to the frame 17. Then, the parallel pin 60 is put through the hole 17*d* of the frame 17 and the hole of the cleaning means holding frame 13. As for the sealing member 21, it is peeled away from the frames 17, and the hole 16*c* of the container 16, through which toner is sent to the developing means holding frame 17, is resealed with a toner seal. Next, the toner cap 16*g* is removed, and toner is refilled into the container 16 through the toner inlet 16*f*, with the use of a funnel 28, as shown in FIG. 21. Then, the sealing member 21 is pasted to the edges of the aforementioned holes 16*c* and 17*a*.

(Assembly Method)

Figure 15:
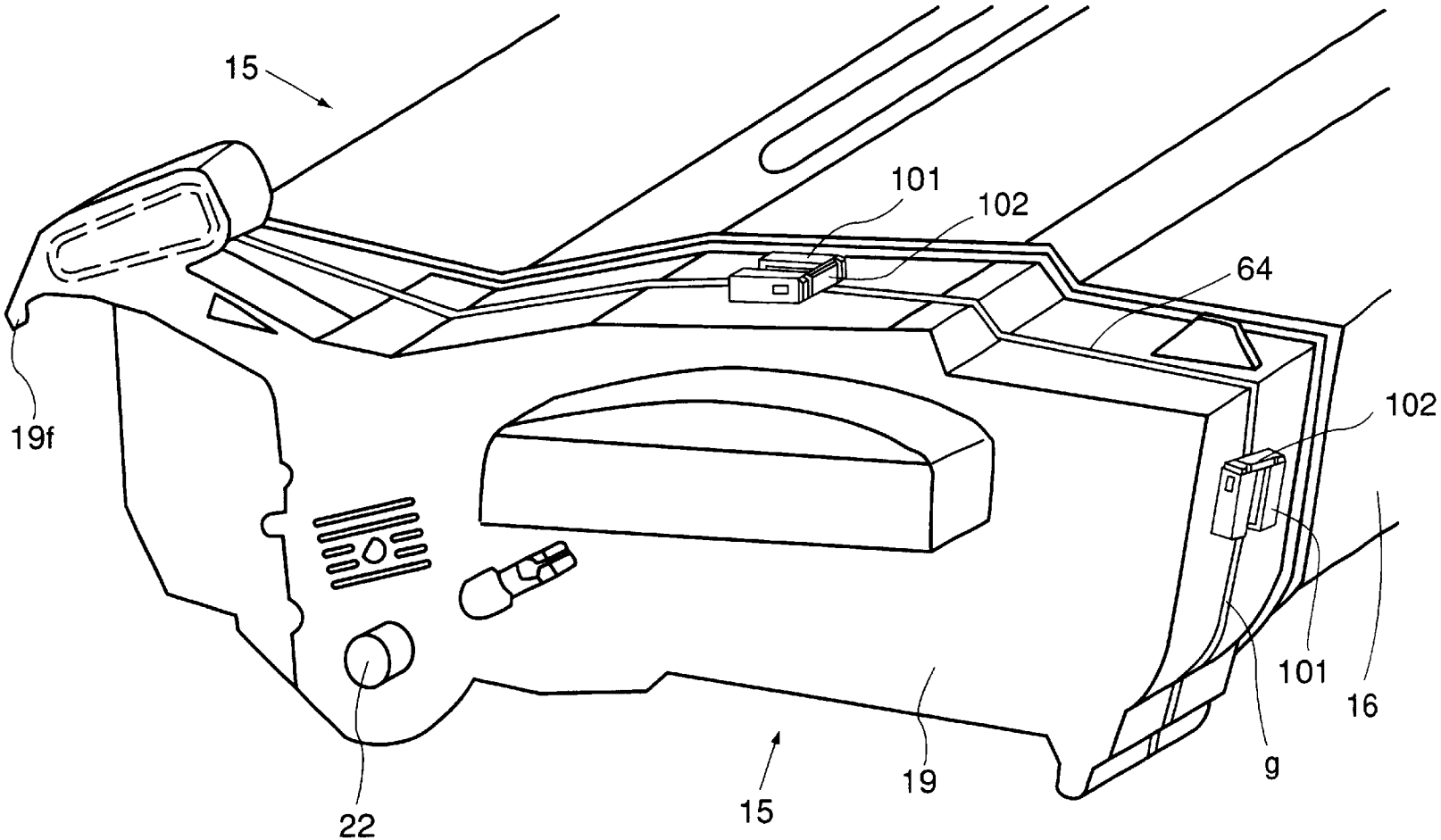
FIG. 15 is a perspective view of one of the lengthwise ends of the process cartridge, to the side cover of which the fastening members have been engaged to the positioning members after the cutting of the frames.

After being separated and overhauled as described above, the frame and cover portions of the cartridge 15 are reassembled in the following manner. First, the portion of the cover 19 (20) separated from the main section of the cartridge 15 is approximately aligned with the portion of the cover 19 (20) remaining connected to the main section of the cartridge 15, and the fastening member 102 is inserted into the single-piece positioning member 101, completing the cartridge 15. FIG. 15 shows the cartridge 15 after this temporary reassembly. A part of the cover 19 (20) was eliminated by the cutting during the disassembly. Thus, the insertion of the fastening member 102 into the single-piece positioning member 101 leaves a gap g which corresponds in size to the portion of the cover 19 (20) eliminated by the cutting. However, the separated portion of the cover 19 (20) is precisely positioned relative to the main section of the cartridge 15 in all of the X, Y, and Z directions in the drawing, because the plurality of single-piece positioning members 101 were attached to the cover 19 (20) prior to the cutting; more specifically, the position of each single-piece positioning member was precisely fixed relative to the cover 19 (20) before the cutting, and a positioning member and a fastening member were fabricated so that they matched to each other in both configuration and measurements. This assembly method can also be used for reassembling a process cartridge which is obtained by overhauling a used process cartridge using the above described disassembling and reassembling methods.

(Embodiment 4)

Figure 16:
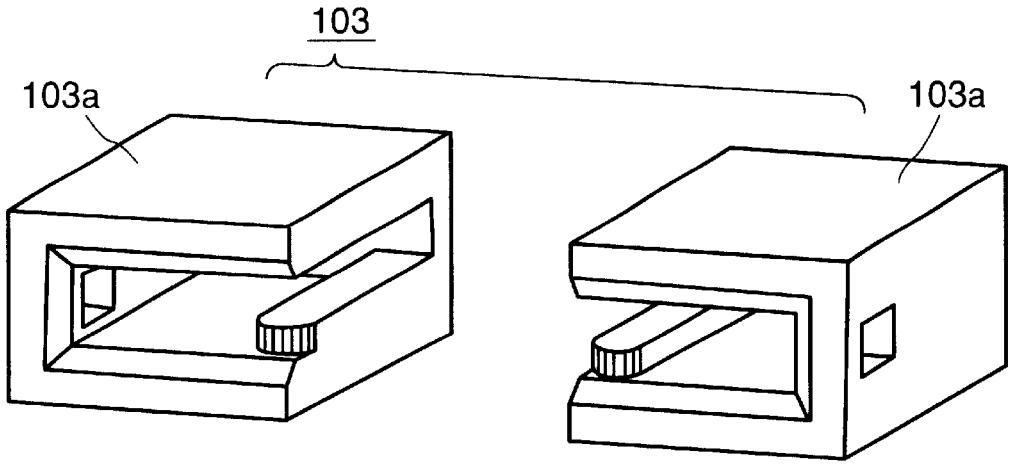
FIG. 16 is a perspective view of the positioning members in the fourth embodiment of the present invention.
Figure 17:
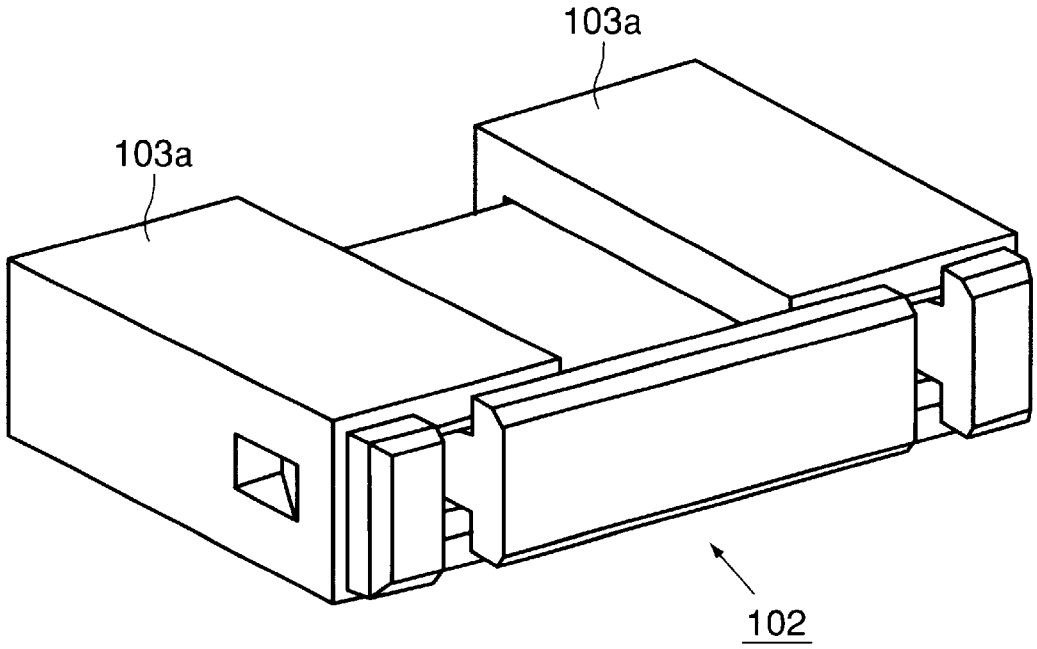
FIG. 17 is a perspective view of the assembled positioning/fastening apparatus in the fourth embodiment.

FIG. 16 shows a two-piece positioning member 103 used in the fourth embodiment of the present invention. This two-piece positioning member 103 also comprises a pair of receptacle portions 103*a*. Unlike the single-piece positioning member 101 in the third embodiment, the receptacle portions 103*a* of this two-piece positioning member 103 are not directly connected to each other. However, this two-piece positioning member 103 is identical in function to the single-piece positioning member 101 in the third embodiment. Therefore, reference to the description of the single-piece positioning member 101 in the third embodiment suffices as the description of the two-piece positioning member 103 in this embodiment. The fastening members used in this embodiment are identical to the fastening member 102 shown in FIGS. 11 and 12.

(Disassembly Method)

In this embodiment, each two-piece positioning member 103 is attached to the cover 19 (20) of the cartridge 15 after it is engaged with a fastening member 102. Then, the fastening member 102 is removed before the cutting of the cover 19 (20), across the portion between the receptacle portions 103*a* and 103*a*.

Compared to the third embodiment, the disassembly method in this embodiment requires additional steps: a step to engage each two-piece positioning member with a fastening member 102 before its attachment, and a step to remove the fastening member 102 from each two-piece positioning member 103 before the cutting of the covers. However, the disassembly method in this embodiment does not require the cutting of the connective portion, and therefore, is simpler in terms of the cutting operation. The assembly method in this embodiment is identical to that in the third embodiment, and therefore, its description will be omitted here.

(Embodiment 5)

Figure 18:
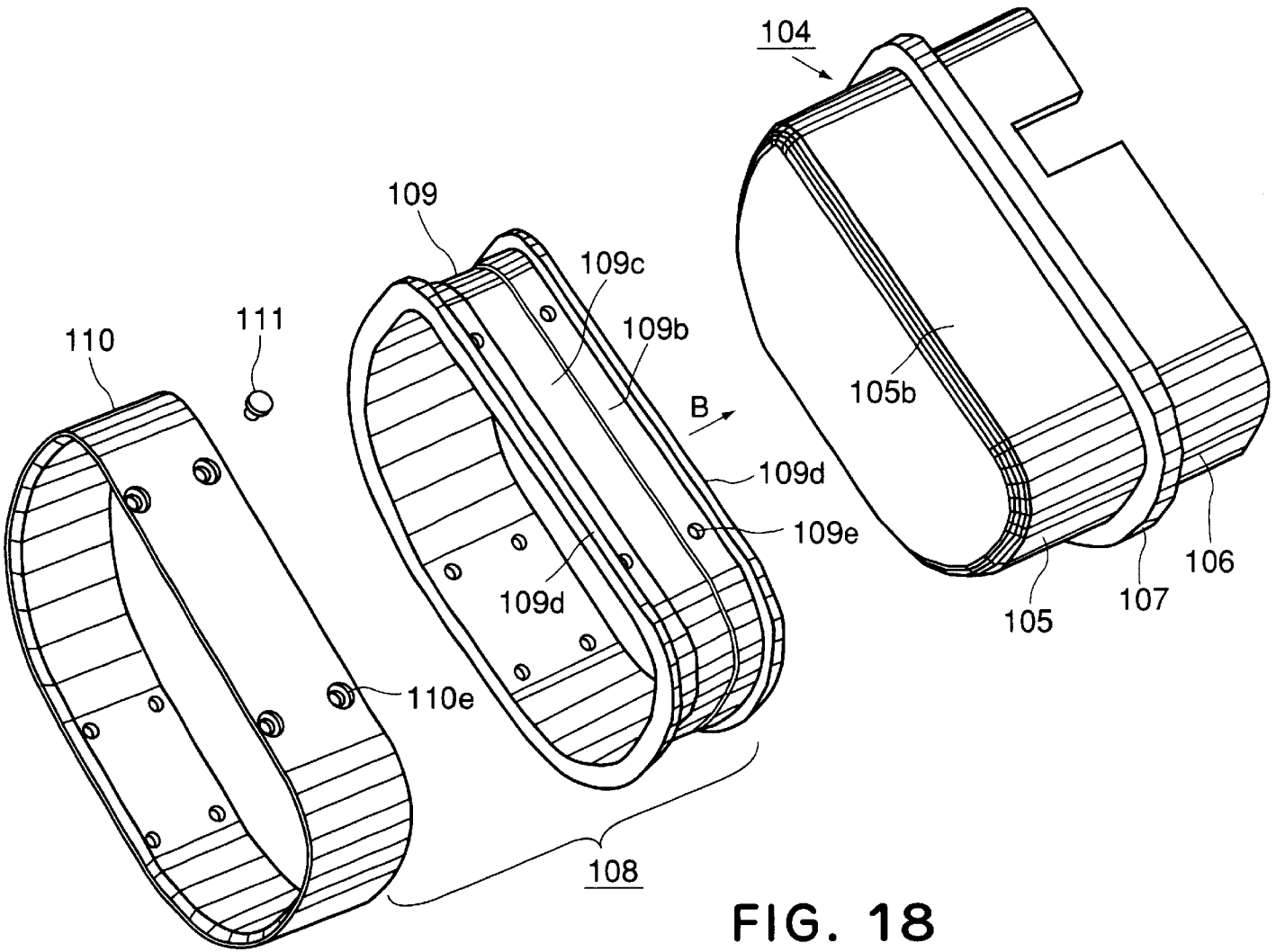
FIG. 18 is a perspective view of the positioning/fastening apparatus in the fifth embodiment of the present invention.

Next, referring to FIGS. 18 to 20, the fifth embodiment of the present invention will be described. FIG. 18 is an exploded perspective view of a positioning/fastening member and a side cover 105, for depicting the cartridge remanufacturing method in this embodiment. In the case of this cartridge 104, the side cover 105 is attached to the main portion 106 of the cartridge 104 comprising the frame 13, the container 16, and the like, with the use of a joint or connective portion 107. In FIG. 18, the cartridge 104 is unshown except for the portion 106 and connective portion 107. The connective portion 107 is attached by the aforementioned melted resin, ultrasonic welding, or the like. The side cover 105 is simpler in configuration than those in the first to fourth embodiments. The positioning/fastening apparatus 108 comprises a positioning member 109 and a fastening member 110, and will be described later in detail. A pin 111 is for securing the positioning member 109 and fastening member 110 relative to each other.

Figure 19:
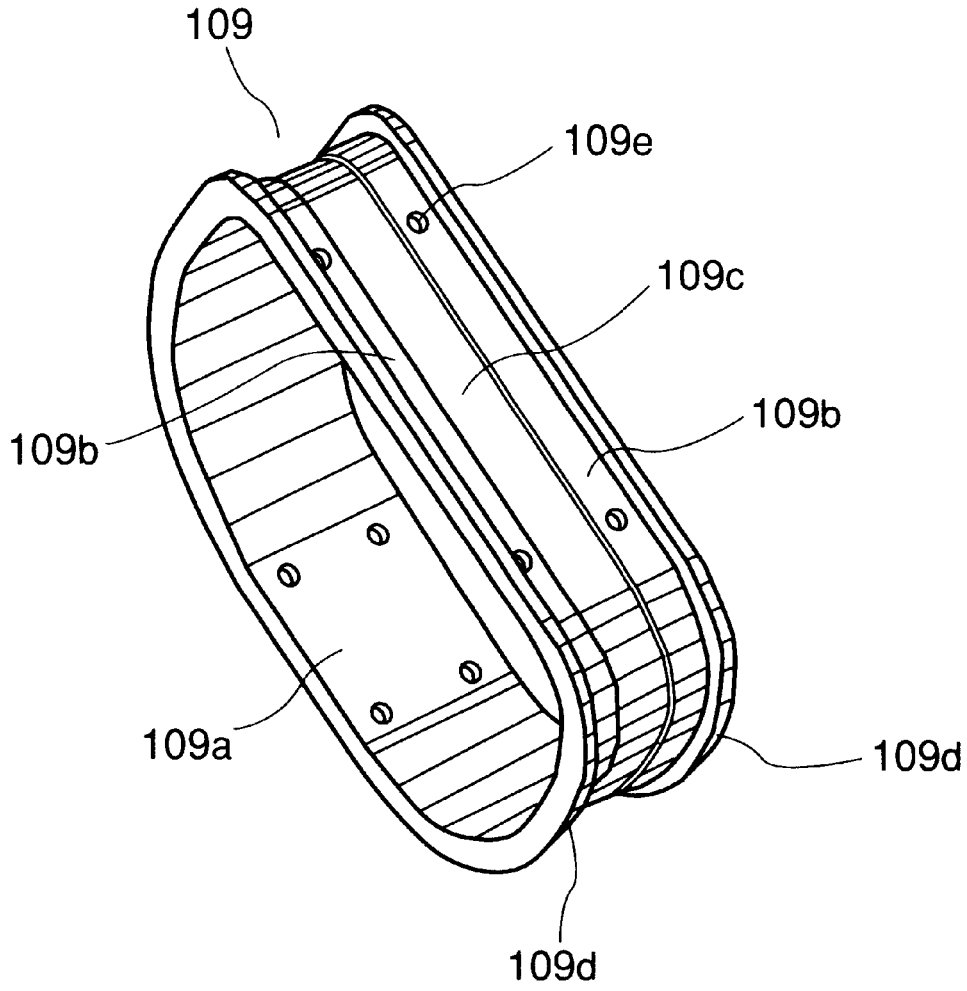
FIG. 19 is a perspective view of the positioning member in the fifth embodiment.

FIG. 19 shows the positioning member 109. The internal surface 109*a* of the positioning member 109 matches in shape with the external surface 105*b* of the cover 105. The positioning member 109 comprises a pair of positioning portions 109*b* and a connective portion 109*c* which connects the pair of positioning portions 109*b*. The details of the positioning member 109 will be given later. The positioning member 109 also comprises a pair of flange portions 109*d* located at the outward lips of the positioning portions 109*b*, one for one, and a plurality of holes 109*e*, into each of which the pin 111 is inserted for the securing the positioning member and fastening member to each other.

Figure 20:
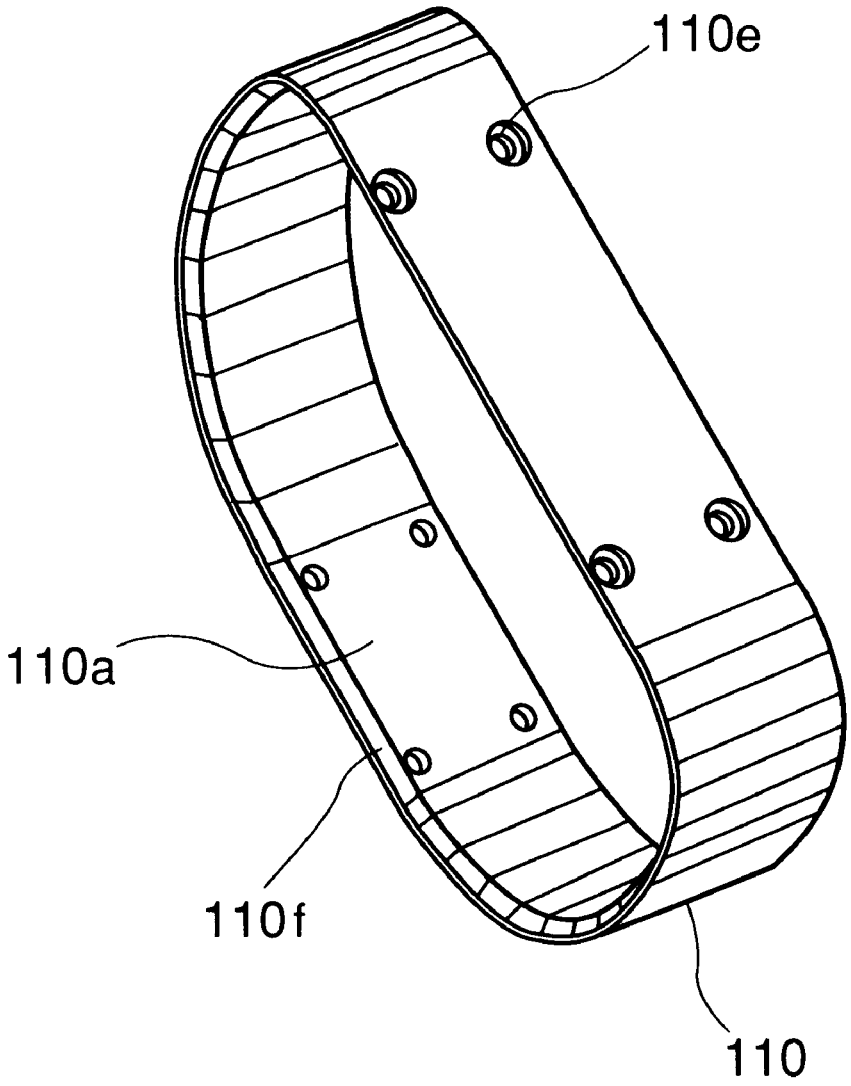
FIG. 20 is a perspective view of the fastening member in the fifth embodiment.

FIG. 20 shows the fastening member 110. The internal surface 110*a* is matched in configuration and size to the external surface of each of the positioning portions 109*b*. The width of the fastening member 110 is virtually equal to the distance between the two flange portions, more specifically, between the mutually facing surfaces of the two flange portions 109*d*. To each of the plurality of holes 110*e* of the fastening member 110, the wall of which is stepped, the pins 111 is inserted. The lip portion of each hole 110*e* is chamfered (surface 110*f*).

(Disassembly Method)

First, the positioning member 109 is fitted around the cover 105 by moving the positioning member 109 in the direction indicated by an arrow mark B as shown in FIG. 18, until the inward end surface of the flange portion 109*d*, with reference to the cartridge, comes into contact with the joint portion 107 of the cartridge. As for the securing method, a semipermanent means such as gluing is used. Thereafter, the positioning member 109 is cut, together with the cover 105, in the direction perpendicular to the lengthwise direction of the cartridge, across a predetermined portion of the connective portion 109*c*, by moving such a tool as an ultrasonic cutter, a circular saw, or the like, in a manner to follow the circumference of the cartridge. As a result, the cover 105 is cut into two pieces.

(Assembly Method)

Around the positioning portion 109*b* of the positioning member 109 on one of the two cover pieces created by the cutting (which here is assumed to be the piece remaining attached to the joint portion 107), the fastening member 110 is fitted. Then, the fastening member 110 is moved toward the flange portion 109*d* of the positioning member 109 until its inwardly facing end surface of the fastening member 110, with respect to the cartridge, comes into contact with the outwardly facing end surface of the flange 109*d*, with respect to the cartridge.

Next, the positioning portion 109*b* of the positioning member 109 on the cover 105 piece separated from the main section of the cartridge is inserted into the fastening member 110, deeply enough for the inwardly facing end surface, with respect to the cartridge, of the flange portion 109*d* of the positioning member 109 to come into contact with the outwardly facing end surface of the fastening member 110. Next, the plurality of pins 111 are put through the holes 110*e* of the fastening member 110, and the holes 109*e* of the positioning member 109, one for one, and are secured thereto.

As described above, according to this embodiment, the positioning member 109 is attached to the cover 105 before the cutting of the cover 105. Therefore, the portion of the cover 105 separated from the main section of the cartridge can be reattached to the main section, precisely in alignment with the main section in all of the X, Y, and Z directions in the drawing, since the position of the positioning member 109 is fixed relative to the side cover 105 before the cutting of the side cover 105, and the positioning member 109 and fastening member 110 are matched to each other in configuration and measurements. Incidentally, this reassembly method can also be used for reassembling a process cartridge which is obtained by overhauling a used process cartridge using this disassembling and reassembling methods.

As described above, according to this embodiment, a positioning member is attached to a part of a cartridge before cutting the cartridge. Then, the portion of the cartridge separated from the main section of the cartridge is reattached to the main section with the use of a fastening member, which matches in configuration and measurements the positioning member. With this arrangement, the separated portion of the cartridge can be reattached to the main section of the cartridge as precisely in alignment with the main section as it was before the cutting, making it possible to remanufacture a cartridge at the same level of accuracy as that at which it was manufactured. Also with this arrangement, the number of the recyclable components is increased, contributing to the efficient usage of natural resources as well as environmental protection.

The above described embodiments of the present invention include a process cartridge remanufacturing method which involves simultaneously a substantial number of process cartridges with an expired service life, as well as a process cartridge remanufacturing method which involves a single process cartridge with an expired service life. In the case of the former, a substantial number of expired process cartridges are recovered, and disassembled. Then, the components removed from the disassembled process cartridges are sorted into groups of the identical components. Then, as large as possible a number of process cartridges are reassembled from the groups of sorted recyclable components, and some new replacement components for the nonrecyclable old components. In the case of the latter, the expired process cartridges are remanufactured one by one. In other words, each time an expired process cartridge is recovered, it is disassembled, and reassembled using the same old components removed therefrom, some new replacement components for the nonrecyclable old components, or some old recyclable components removed from the other recovered cartridges.

The present invention includes any of the following cases:

(1) each expired process cartridge is overhauled using only the components therein;

(2) each expired process cartridge is overhauled using, in principle, the components therein, with the exception of the new replacement components, or the recyclable old components from the other expired cartridge, which replace the original components that are nonrecyclable due to service life expiration, damages, malfunctions, or the like;

(3) a plurality of expired process cartridges are overhauled together; the components removed from the plurality of expired process cartridges are sorted into groups of the identical components, and as large as possible a number of process cartridges are reassembled using only the components from the groups of the original components; and (4) a plurality of expired process cartridges are overhauled together; the components removed from the plurality of expired process cartridges are sorted into groups of the identical components, and as large as possible a number of process cartridges are reassembled using, in principle, the components from the groups of the original components, except for a certain number of new replacement components which replace the original components nonrecyclable due to service life expiration, or the like.

The aforementioned components are the structural components disclosed in the claim portion of this specification, that is, the components which make up the above described portions of the process cartridge. It also includes the smallest components or units, into which the process cartridge can be disassembled.

As described above, the present invention is a realization of a simple process cartridge remanufacturing method regarding the assembly and disassembly of a process cartridge. The positioning/joining apparatus in accordance with the present invention is very effective when used during the process cartridge reassembly.

While the invention has been described with reference to the structures disclosed herein, it is not confined to the details set forth, and this application is intended to cover such modifications or changes as may come within the purposes of the improvements or the scope of the following claims.

What is claimed is:

1. A disassembling method for a process cartridge detachably mountable to a main assembly of an electrophotographic image forming apparatus, wherein the process cartridge includes an electrophotographic photosensitive drum, a developing roller for developing an electrostatic latent image formed on the electrophotographic photosensitive drum, a drum supporting frame configured and positioned to rotatably support the electrophotographic photosensitive drum, a developer accommodating container configured to accommodate a developer to be supplied to the developing rollers, a developing device frame configured and positioned to support the developing roller, and covering members connected to the drum supporting frame and the developer accommodating container at ends of the drum supporting frame and the developer accommodating container with respect to a longitudinal direction of the electrophotographic photosensitive drum, said disassembling method comprising:

a step of cutting said covering members adjacent to a connecting portion between the covering members and the drum supporting frame and a connecting portion between the covering members and the developer accommodating container along an outer wall of the covering members, wherein the developing device frame of the process cartridge supports the developing roller, and the developing device frame has an arm portion projected toward the drum supporting frame at one longitudinal end of the developing roller and is rotatably connected to the drum supporting frame by a pin member adjacent to a free end portion of the arm portion; and a step of removing the pin member after said covering members cutting step.

2. A method according to claim 1, wherein the process cartridge further includes an exposure opening extending in the longitudinal direction of the electrophotographic photosensitive drum to permit light from exposure means provided in the main assembly of the electrophotographic image forming apparatus to be incident on the electrophotographic photosensitive drum, said method further comprising:

a step of cutting a portion between one longitudinal end portion of the exposure opening and a cutting portion cut in said step of cutting the covering members which is adjacent one longitudinal end portion of one of the covering members.

3. A method according to claim 1 or 2, wherein said process cartridge further includes an image transfer opening configured and positioned to transfer onto a recording material a visualized image provided by the developing roller from an electrostatic latent image on the electrophotographic photosensitive drum, said method further comprising:

a step of cutting a portion between one longitudinal end portion of the image transfer opening and a cutting portion cut in said step of cutting the covering members which is adjacent one longitudinal end portion of one of the covering members.

4. A method according to claim 1, wherein the process cartridge further includes a drive transmission member which is provided at a longitudinally outside part of the drum supporting frame, the developer accommodating container, or the developing device frame and which is covered by one of the covering members, said method further comprising:

a step of removing the drive transmission member after said covering members cutting step.

5. A disassembling method for a process cartridge detachably mountable to a main assembly of an electrophotographic image forming apparatus, wherein the process cartridge includes an electrophotographic photosensitive drum, a drum supporting frame configured and positioned to rotatably support a developing roller for developing an electrostatic latent image formed on the electrophotographic photosensitive drum and the electrophotographic photosensitive drum, an exposure opening extending in the longitudinal direction of the electrophotographic photosensitive drum to permit light from exposure means provided in the main assembly of the electrophotographic image forming apparatus to be incident on the electrophotographic photosensitive drum, a developer accommodating container configured to accommodate a developer to be supplied to the developing roller, a developing device frame configured and positioned to support the developing roller, and covering members connected to the drum supporting frame and the developer accommodating container at ends of the drum supporting frame and the developer accommodating container with respect to a longitudinal direction of the electrophotographic photosensitive drum, an image transfer opening configured and positioned to transfer onto a recording material a visualized image provided by the developing roller from an electrostatic latent image on the electrophotographic photosensitive drum, said disassembling method comprising:

a step of cutting a portion of the process cartridge between one longitudinal end portion of the exposure opening and one longitudinal end portion of the image transfer opening adjacent the one longitudinal end portion of the exposure opening, along an outer wall of the process cartridge.

6. A method according to claim 5, wherein the exposure opening is provided on the drum supporting frame, and the image transfer opening is defined along a longitudinal direction of the electrophotographic photosensitive drum between the drum supporting frame and the developing device frame when one of the covering members is connected to the drum supporting frame and the developer accommodating container, said method further comprising, a step of cutting the drum supporting frame and one of the covering members along an outer wall of the process cartridge.

7. A method according to claim 5 or 6, further comprising a step of cutting a portion between the other longitudinal end portion of the exposure opening and the other longitudinal end portion of the image transfer opening along an outer wall of the process cartridge.

8. A method according to claim 5 or 6, wherein the developing device frame of the process cartridge supports the developing roller and the developing device frame has an arm portion projected toward the drum supporting frame at one longitudinal end of the developing roller and is rotatably connected to the drum supporting frame by a pin member adjacent to a free end portion of the arm portion, said method further comprising:

a step of cutting a portion of the process cartridge corresponding to a center of rotation of one of the covering members to provide an opening, accessing the pin member through the thus provided opening, and removing the pin member.

9. A process cartridge remanufacturing method for remanufacturing a process cartridge which is detachably mountable to a main assembly of an electrophotographic image forming apparatus and which includes an electrophotographic photosensitive drum, process means actable on the electrophotographic photosensitive drum and a frame configured and positioned to cover the electrophotographic photosensitive drum and the process means, said method comprising:

(a) a step of mounting at least one pair of positioning members on the frame;

(b) a step of cutting a portion of the process cartridge between the one pair of positioning members into divided parts; and (c) a step of connecting the divided parts by a connecting member while the parts are positioned with respect to the pair of positioning members.

10. A process cartridge remanufacturing method according to claim 9, wherein the pair of positioning members is formed into an integrated member by a connecting portion, and is cut in said cutting step.

11. A process cartridge remanufacturing method according to claim 10, wherein the pair of positioning members and a coupling member are disconnectably connected.

12. A process cartridge remanufacturing method according to claim 11, wherein the pair of positioning members is mounted to the frame with the pair of positioning members being connected with the coupling member, and thereafter, the coupling member is removed, and then the frame is cut.

13. A process cartridge disassemblying method for remanufacturing a process cartridge which is detachably mountable to a main assembly of an electrophotographic image forming apparatus and which includes an electrophotographic photosensitive drum, process means actable on the electrophotographic photosensitive drum and a frame covering the electrophotographic photosensitive drum and the process means, said method comprising:

(a) a step of mounting at least one pair of positioning members on the frame;

(b) a step of cutting a portion of the process cartridge between the pair of positioning members into divided parts; and (c) a step of connecting the divided parts by a connecting member while the parts are positioned with respect to the pair of positioning members.

14. A method according to claim 13, wherein the pair of positioning members is connected into an integral part and is cut by said cutting step.

15. A method according to claim 13 or 14, wherein the pair of positioning members and a coupling member can be disconnectably connected to each other.

16. A method according to claim 15, wherein the pair of positioning members are mounted to the frame with the pair of positioning members being connected with the coupling member, and thereafter, the coupling member is removed, and then the frame is cut.

17. An assembling method for a process cartridge which is detachably mountable to a main assembly of an electrophotographic image forming apparatus and which includes an electrophotographic photosensitive drum, process means actable on the electrophotographic photosensitive drum and a frame covering the electrophotographic photosensitive drum and the process means, said method comprising:

(a) a step of preparing a process cartridge which has been divided into parts by mounting at least one pair of positioning members on the frame and cutting the process cartridge at a portion thereof between the positioning members constituting the pair; and (b) a step of connecting the divided parts by a connecting member while the parts are positioned with respect to the pair of positioning members.

18. An assembling method for a process cartridge according to claim 17 wherein the pair of positioning members and the connecting member can be disconnectably connected to each other.

19. A positioning and connection apparatus for connecting frames provided by cutting a process cartridge which is detachably mountable to a main assembly of an electrophotographic image forming apparatus and which includes an electrophotographic photosensitive drum, process means actable on the electrophotographic photosensitive drum and a frame covering the process means, said apparatus comprising:

a pair of positioning members mounted on the frame prior to cutting the frame;

a coupling member mounted to said pair of positioning members to connect said cut frame; and positioning means for determining the relative position between said pair of positioning members and said coupling member.

20. An apparatus according to claim 19, wherein said pair of positioning members is connected into an integral part and is cuttable in a cutting step.

21. An apparatus according to claim 19, wherein said pair of positioning members and said coupling member can be disconnectably connected to each other.

22. A process cartridge detachably mountable to a main assembly of an electrophotographic image forming apparatus, said process cartridge comprising:

an electrophotographic photosensitive drum;

process means actable on said electrophotographic photosensitive drum;

a frame configured and positioned to cover said process means, a first frame portion of said frame;

a second frame portion of said frame; and at least one pair of positioning members, wherein one of said positioning members is mounted to said first frame portion, and another one of said positioning members is mounted to said second frame portion;

wherein said first frame portion and said second frame portion are connected to each other by said at least one pair of positioning members extending between said first frame portion and said second frame portion and a coupling member connecting said positioning members constituting the pair, with each other.

23. A process cartridge according to claim 22, wherein said pair of positioning members and the coupling member are removably connected.

* * * * *

UNITED STATES PATENT AND TRADEMARK OFFICE

CERTIFICATE OF CORRECTION

PATENT NO. : 6,788,908 B2
DATED : September 7, 2004
INVENTOR(S) : Kazumi Sekine

It is certified that error appears in the above-identified patent and that said Letters Patent is hereby corrected as shown below:

Column 1,
Line 16, “cartraidge” should read -- cartridge --.

Column 2,
Line 3, “forms” should read -- form --.

Column 3,
Line 34, “process” should read -- Process --.
Line 54, “means:” should read -- means; --.

Column 4,
Line 31, “it” should read -- its --.

Column 7,
Line 29, “an” should read -- a --.

Column 8,
Line 1, “lidless” should read -- lid-less --.

Column 12,
Line 54, “other:” should read -- other; --.

Column 16,
Line 15, “in configuration and measurements the positioning member” should read -- the positioning member in configuration and measurements --.

Signed and Sealed this

Fourth Day of January, 2005

JON W. DUDAS
*Director of the United States Patent and Trademark Office*